US009675510B2

(12) United States Patent
Moerth-Cross

(10) Patent No.: US 9,675,510 B2
(45) Date of Patent: Jun. 13, 2017

(54) EXERCISE AND MASSAGE TREATMENT TABLE SYSTEM

(71) Applicant: Michele Moerth-Cross, Sherman Oaks, CA (US)

(72) Inventor: Michele Moerth-Cross, Sherman Oaks, CA (US)

( * ) Notice: Subject to any disclaimer, the term of this patent is extended or adjusted under 35 U.S.C. 154(b) by 1 day.

(21) Appl. No.: 14/869,587

(22) Filed: Sep. 29, 2015

(65) Prior Publication Data

US 2016/0096062 A1 Apr. 7, 2016

Related U.S. Application Data

(60) Provisional application No. 62/059,016, filed on Oct. 2, 2014.

(51) Int. Cl.
*A63B 21/062* (2006.01)
*A61G 13/00* (2006.01)
(Continued)

(52) U.S. Cl.
CPC ..... *A61G 13/009* (2013.01); *A61G 13/105* (2013.01); *A63B 21/023* (2013.01);
(Continued)

(58) Field of Classification Search
CPC ..... A63B 21/00058; A63B 21/00061; A63B 21/00065; A63B 21/00069; A63B 21/00178; A63B 21/00181; A63B 21/00185; A63B 21/002; A63B 21/0023; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/062; A63B 21/0622; A63B 21/0624; A63B 21/0626; A63B 21/0628; A63B 21/063; A63B 21/0632; A63B 21/068; A63B 21/08; A63B 21/15; A63B 21/151; A63B 21/154; A63B 21/156; A63B 21/16; A63B 21/1618; A63B 21/1627; A63B 21/1636; A63B 21/1645; A63B 21/1654; A63B 21/1663;
(Continued)

(56) References Cited

U.S. PATENT DOCUMENTS 332,989 A * 12/1885 Benedict ..... A63B 21/0628 482/102
382,440 A * 5/1888 Sanchez ..... A63B 21/0628 16/216

(Continued)

*Primary Examiner* — Sundhara Ganesan
*Assistant Examiner* — Gary D Urbiel Goldner
(74) *Attorney, Agent, or Firm* — Kelly & Kelley, LLP

(57) ABSTRACT

An exercise and massage treatment table system that includes a housing unit mounted on a vertical surface. The housing unit accepts a massage table having foldable legs, headrests, and side platforms. The massage table may be stored in the housing unit or placed in a standing position. The housing unit may also include a storage unit or an exercise unit. The exercise unit may include a pair of cable and pulley systems mounted on vertical exercise tracks. The massage table may also include rotator discs in the upper surface for added rotational action during exercise.

25 Claims, 20 Drawing Sheets

(51) Int. Cl.

| | |
|---|---|
| ***A61G 13/10*** | (2006.01) |
| ***A63B 21/02*** | (2006.01) |
| ***A63B 21/04*** | (2006.01) |
| *A63H 3/52* | (2006.01) |
| *A63B 21/00* | (2006.01) |
| *A63B 71/00* | (2006.01) |
| *A63B 21/16* | (2006.01) |

(52) U.S. Cl.
CPC ..... *A63B 21/0442* (2013.01); *A63B 21/0626* (2015.10); *A63B 21/154* (2013.01); *A63B 21/4043* (2015.10); *A63B 21/00065* (2013.01); *A63B 21/00185* (2013.01); *A63B 21/169* (2015.10); *A63B 21/4029* (2015.10); *A63B 21/4034* (2015.10); *A63B 21/4035* (2015.10); *A63B 71/0036* (2013.01); *A63B 2210/06* (2013.01); *A63B 2225/093* (2013.01); *A63H 3/52* (2013.01)

(58) Field of Classification Search
CPC ... A63B 21/169; A63B 21/22; A63B 21/4027; A63B 21/4029; A63B 21/4031; A63B 21/4033; A63B 21/4034; A63B 21/4035; A63B 21/4039; A63B 21/4043; A63B 21/4045; A63B 21/4047; A63B 21/4049; A63B 22/0046; A63B 22/20; A63B 22/201; A63B 22/205; A63B 23/0205; A63B 23/0211; A63B 23/0216; A63B 23/0222; A63B 23/035; A63B 23/03508; A63B 23/03516; A63B 23/03533; A63B 23/03541; A63B 23/0355; A63B 23/03558; A63B 23/03566; A63B 23/04; A63B 23/0405; A63B 23/0482; A63B 23/0488; A63B 23/0494; A63B 23/08; A63B 23/12; A63B 23/1209; A63B 23/1245; A63B 23/1281; A63B 69/0057; A63B 71/0036; A63B 2208/0228; A63B 2208/0238; A63B 2208/0242; A63B 2208/0252; A63B 2210/06; A63B 2210/50; A63B 2210/58; A63B 2225/09; A63B 2225/093; A63B 2225/10; A63B 2225/102; A61G 13/009; A61G 13/10; A61G 13/105; A61G 13/12; A61G 13/1205; A61G 13/121
USPC ..... 5/1, 2.1, 3, 6, 933
See application file for complete search history.

(56) References Cited

U.S. PATENT DOCUMENTS

| | | | | | |
|---|---|---|---|---|---|
| 491,326 | A * | 2/1893 | Whitney | A63B 21/0628 | 482/102 |
| 960,213 | A * | 5/1910 | Williams | A47B 5/06 | 108/48 |
| 1,646,818 | A * | 10/1927 | Holland | A63B 17/00 | 482/102 |
| 1,696,145 | A * | 12/1928 | Wagoner | D06F 81/06 | 108/134 |
| 1,776,204 | A * | 9/1930 | Tascarella | A61G 13/105 | 269/901 |
| 2,219,219 | A * | 10/1940 | Boger | A63B 23/00 | 190/1 |
| 2,474,060 | A * | 6/1949 | Mosher | A63B 17/00 | 482/39 |
| 2,632,645 | A * | 3/1953 | Barkschat | A63B 3/00 | 108/39 |
| 2,788,528 | A * | 4/1957 | Hansen | A47C 17/48 | 5/149 |
| 3,042,978 | A * | 7/1962 | Eames | A47B 47/00 | 108/48 |
| 3,062,544 | A * | 11/1962 | Viets | A47B 5/06 | 108/166 |
| 3,129,676 | A * | 4/1964 | Brooks | A47B 77/10 | 108/33 |
| 3,741,538 | A * | 6/1973 | Lewis | A63B 17/00 | 482/120 |
| 3,874,657 | A * | 4/1975 | Niebojewski | A63B 17/00 | 482/104 |
| 4,180,062 | A * | 12/1979 | Alberti | A61B 5/02411 | 297/16.1 |
| 4,300,761 | A * | 11/1981 | Howard | A63B 17/00 | 482/130 |
| 4,431,181 | A * | 2/1984 | Baswell | A63B 21/154 | 482/102 |
| 4,679,787 | A * | 7/1987 | Guilbault | A47C 17/38 | 482/54 |
| 4,829,610 | A * | 5/1989 | Gonzalez-Alvarez | A47C 17/38 | 182/34 |
| 4,862,611 | A * | 9/1989 | Wright | D06F 81/06 | 108/38 |
| 4,976,428 | A * | 12/1990 | Ghazi | A63B 23/03575 | 482/112 |
| 5,570,642 | A * | 11/1996 | Lehrman | D06F 81/06 | 108/134 |
| D404,443 | S * | 1/1999 | Doyle | D21/675 | |
| 5,974,979 | A * | 11/1999 | Grady | A47B 3/087 | 108/123 |
| 6,182,578 | B1 * | 2/2001 | Fanuzzi | A47B 3/0912 | 108/132 |
| 6,520,890 | B2 * | 2/2003 | Hsu | A63B 22/02 | 482/51 |
| 6,574,807 | B1 * | 6/2003 | Gonzalez | A47C 17/58 | 5/149 |
| 6,684,540 | B1 * | 2/2004 | Tufts | D06F 81/06 | 38/137 |
| 7,395,620 | B1 * | 7/2008 | McNeely | D06F 81/06 | 108/48 |
| 7,610,863 | B1 * | 11/2009 | Smith-Huebner | A47B 3/091 | 108/36 |
| 7,636,967 | B1 * | 12/2009 | Stokes | A61G 13/009 | 5/620 |
| 8,272,089 | B1 * | 9/2012 | Stokes | A61G 13/009 | 5/620 |
| 9,119,467 | B2 * | 9/2015 | Elizondo, Jr. | A47B 77/10 | |
| 2005/0248204 | A1 * | 11/2005 | Berg | A47C 7/36 | 297/452.11 |
| 2009/0211584 | A1 * | 8/2009 | Savich | A61G 13/009 | 128/845 |
| 2010/0011500 | A1 * | 1/2010 | Swierski | A47C 17/22 | 5/1 |
| 2010/0058958 | A1 * | 3/2010 | Christian | A47B 3/0912 | 108/19 |
| 2010/0257673 | A1 * | 10/2010 | Linares | A61G 1/013 | 5/626 |
| 2010/0325798 | A1 * | 12/2010 | Savich | A61G 13/009 | 5/615 |
| 2012/0271350 | A1 * | 10/2012 | Palmer | A61G 13/009 | 606/242 |
| 2013/0098276 | A1 * | 4/2013 | Trinko | A61G 13/009 | 108/33 |
| 2015/0087486 | A1 * | 3/2015 | Franks | A63B 21/0442 | 482/129 |
| 2016/0074698 | A1 * | 3/2016 | Figueroa | A47C 17/38 | 5/2.1 |

* cited by examiner

EXERCISE AND MASSAGE TREATMENT TABLE SYSTEM

RELATED APPLICATION

This application claims the benefit of U.S. Provisional Application No. 62/059,016, filed on Oct. 2, 2014.

FIELD OF THE INVENTION

The present invention is directed to an exercise and massage system. More particularly, the present invention is directed to a novel Pilates exercise and massage system that incorporates "Murphy bed" style massage-treatment table combined with an exercise system.

The invention is related to the fields of massage, physical therapy, rehabilitation, fitness, body and mind therapies. It has applications for, but not limited to, massage therapists, physiotherapists, sports therapy, Reiki, Rolfing, Feldenkreis, Cranio-Sacral work, Kinesiology, Osteopathy, PHYSIORHYTHMIC® RMBR, and for home use.

SUMMARY OF THE INVENTION

The complete system comes in two parts: a wall unit optionally including a built in pulley and weight system, and a separable folding massage table. The folding massage table has extendable "arms", "legs" and "headrests" that fold into the massage table such that the entire unit can fold up flat into a frame of the wall unit like a "Murphy bed". It offers space saving efficiency and easy access through its storable design.

The space saving, simple and practical design requires a fraction of the "footprint" of traditional massage tables by virtue of its ability to fold up flat into its frame against the wall like a "Murphy bed", as well as allowing it to be free standing when folded out.

Its ergonomic design allows greater comfort and support of shoulders and arms during supine or prone positions due to its extendable triangular wings. This enables the client to remain relaxed within their neck and shoulder girdle, as well as their pelvic and hip region, in prone or supine positions during movement or massage. In addition to the weight pulley/resistance spring system of the wall unit, it enables movement during bodywork.

Additionally, the invention's sleek and elegant design makes it a true piece of art in any environment. Each customer and client can choose from a variety of colors to create their own furniture art piece. While there are many massage tables on the market, the invention offers many unique advantages and features that generally aren't available in other massage units.

The ability for the massage table unit to fold and fit within the wall unit, as well as the combination with the exercise system, gives trainers an alternative to Pilates and Yoga studios. Such system allows for massage and training within a small facility were space saving is a must. The same goes for the home use such as apartments or smaller spaces. Most pulley, weight and resistance equipment is very bulky and takes up a lot of room. It is rare that one can find the combination of a massage table with a weight baring resistance exercise unit compactly stored within its frame against the wall.

The combination of massage table and weight/pulley wall unit is designed for, but not limited to join bodywork with movement as well as encourage non-gripping exercising.

Traditional pulley weight systems in general are not designed to address the multiple layers of the physical body often due to their equipment structure, materials and size of platforms, seats or surfaces during weight/resistance training. In many cases this can produce gripping within joints and muscles, as well as dissecting the upper from the lower body, restricting full movement of major joints such as humeral and femoral joints and the spine. Often the focus is on major superficial muscles.

Through the help of a multitude of individually based resistance-tension settings and a soft gliding pulley weight system, due to ball bearing skateboard-style wheels, the invention allows a more natural movement session. The purpose of the tension system is to reach the body's internal muscles, external muscles and their communication within. This is paramount for joint health and internal "central core" strength. Due to the difference in resistance by the weight pulleys verses the type of resistance the springs produce, one can find the quality of "how to" activate different muscle groups (internal and superficial) individually or combined. The system with it's easy to use and simple construction is capable of re-teaching soft, non-gripping, natural movement in a two or three-dimensional way. The inventive combination achieves valuable benefits for physical health maintenance or rehabilitation.

The present invention is directed to an exercise and massage treatment table system. The system includes a generally rectangular housing unit secured to a vertically oriented surface, the housing unit having an interior compartment. The vertically oriented surface may be a wall or the inside of a case in which the housing unit is secured. Where a case is used, the exercise and massage treatment table system is transportable within the case. The system also includes a pair of guide tracks mounted to opposite side walls of the interior compartment. Each guide track has a first end adjacent to a bottom of the side walls and a second end adjacent to an approximate mid-point of the side walls.

The system includes a massage table having a generally planar surface that approximates a size and shape of the interior compartment of the housing unit. A pair of legs are hingedly attached to opposite first and second end edges of the massage table. Each of the pair of legs are independently configured to pivot approximately ninety degrees between a closed position generally parallel to the planar surface against an underside of the massage table and an open position generally perpendicular to the planar surface. A pair of wheels are rotatably attached to opposite sides of the first end edge of the massage table, wherein each of the pair of wheels are configured to slidably engage one of the pair of guide tracks in the interior compartment.

The massage table is slidably movable within the housing unit between a storage position and a standing position. In the storage position the massage table fits within the interior compartment and the pair of wheels are engaged with the first end of the pair of guide tracks. In the standing position the massage table extends outward from the interior compartment and the pair of wheels are engaged with the second end of the pair of guide tracks. The massage table further has a removed position such that the pair of wheels are separated from the pair of guide tracks. Each of the pair of legs preferably includes a lower extension that is adjustable in length so as to adjust a height of the planar surface from a floor when in the standing position.

The massage table also has a headrest hingedly attached to one of the first or second end edges of the massage table aligned with a headrest cut-out on one of the pairs of legs. The headrest is configured to pivot approximately one hundred eighty degrees between a closed position generally parallel to the planar surface against the underside of the massage table within the headrest cut-out and an open position generally parallel to the planar surface extending away from the end edge to which the headrest is hingedly attached. The massage table may include two headrests, one attached to each of the end edges of the massage table. The massage table may also include a pair of side platforms hingedly attached to opposite first and second side edges of the massage table. Each of the pair of side platforms are independently configured to pivot approximately one hundred eighty degrees between a closed position generally parallel to the planar surface against the underside of the massage table and an open position generally parallel to the planar surface extending away from the side edge to which the side platform is hingedly attached. Each of the pair of side platforms are also independently configured to engage a middle position approximately ninety degrees from either the closed position or the open position, generally perpendicular to the planar surface.

The planar surface of the massage table may also include a rotator disc configured to rotate through a range of motion during exercise. Two rotator discs may be provided.

The system may also have a storage unit mounted on a back wall of the housing unit within the interior compartment. The storage unit presents a vertical wall having a plurality of slots configured to receive towels or sheets. At least one of the plurality of slots may have a metal frame shelf.

The system may alternately have an exercise unit mounted on a back wall of the housing unit within the interior compartment. The exercise unit presents a pair of exercise tracks that extend vertically along the exercise unit and accommodate a cable and pulley exercise system. The pair of exercise tracks may be mounted on raised platforms so as to form a central storage area between the raised platforms and an operating area behind each raised platform.

The cable and pulley exercise system preferably has, a pair of upper pulleys mounted proximate to a top of each of the pair of exercise tracks and a pair of moveable carriages mounted in each of the pair of exercise tracks. One of the pair of upper pulleys is connected by a cable to an associated one of the pair of moveable carriages on the same exercise track, such that when the cable is pulled or released through the upper pulley the associated moveable carriage moves in a corresponding direction along the exercise track. Each of the pair of moveable carriages includes a peg configured to receive weighted plates thereupon. The pair of upper pulleys are preferably each mounted on one of a pair of rotating arms associated with one of the pair of exercise tracks. Each of the pair of moveable carriages is preferably biased by a resistance spring to a bottom of the associated exercise track.

The cable and pulley exercise system may further include a pair of lower pulleys mounted proximate to a bottom of each of the pair of exercise tracks. The cable also connects one of the pair of lower pulleys to an associated one of the pair of moveable carriages on the same exercise track. The pair of lower pulleys are preferably each mounted on one of a pair of rotating arms associated with one of the pair of exercise tracks. Each of the pair of moveable carriages is biased, relative to the pair of upper pulleys, by a bottom resistance spring to the bottom of each of the pair of exercise tracks, and, relative to the pair of lower pulleys, by a top resistance spring to the top of each of the pair of exercise tracks.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE INVENTION

Figure 1:
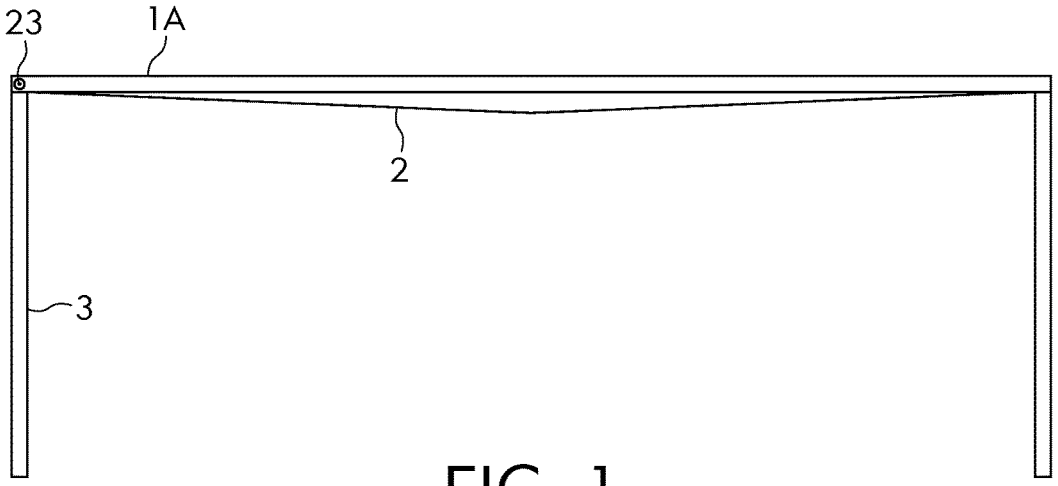
FIG. 1 is a side view of the massage table unit with the legs shortened
Figure 2:
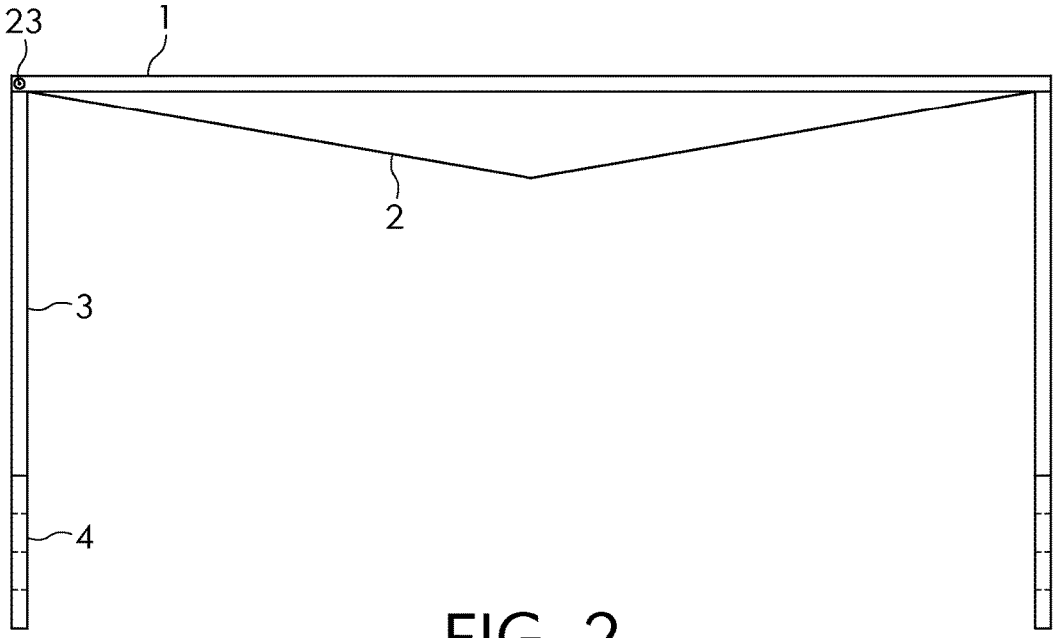
FIG. 2 is a side view of the massage table unit with the legs in full extension and the "winged" arm hanging down at its side.
Figure 4:
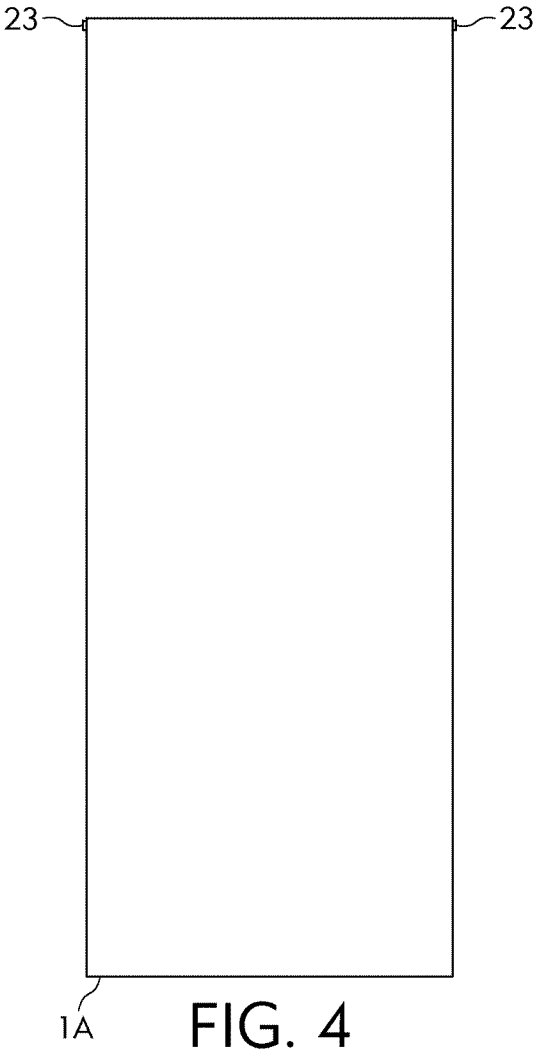
FIG. 4 is a view of the front of the table with legs, arms and headrest folded under, not in view.
Figure 3:
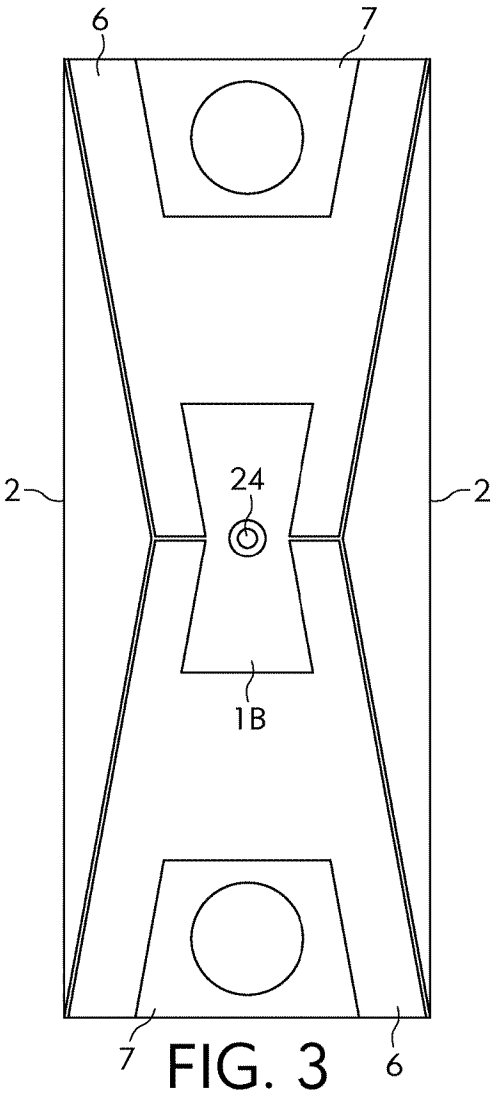
FIG. 3 is a view of the back side of the massage table unit folded up as seen when stored in the wall frame unit.
Figure 6:
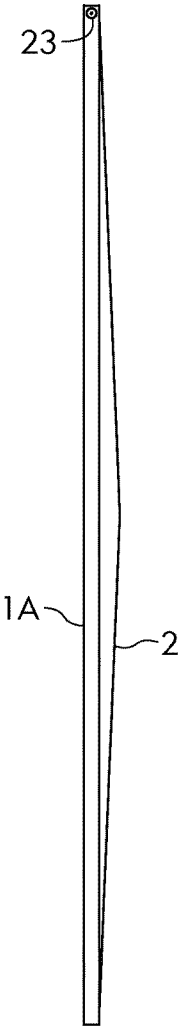
FIG. 6 is a side view of the table with legs, arms and headrest folded under.

Massage Table Unit (FIG. 1-6):

The massage table unit 1 folds within and is stored in the wall unit 21 when not in use. To set up for a treatment or movement session the table 1 can easily glide out of the wall unit 21 due to ball bearing skateboard-style wheels 23 and metal tracks 22 attached on the inside of the wall unit 21. The ergonomic design of the massage table unit 1 offers comfort for the client and practitioner due to its two sculpted legs 3,4, two triangular arms 2 and two headrests 7. The table 1 includes hinges for the legs 3,4, triangular arms 2, and headrests 7, which allow for a quick and easy set up at anytime during the clients massage or training without stopping or disturbing the rhythm of the session.

FIG. 1 shows a side view of the massage table unit 1 with the legs 3 shortened. The legs 3 include a lower extension 4 that may selectively fold or unfold to adjust the height of the table 1. The lower extension 4 may include multiple components for shortening or lengthening purposes to various heights. Each portion of the lower extension 4 has a metal peg and a click-in/screw-in system for added strength and security. This assists in better comfort of the practitioner during seated treatment sessions and enables individual heights for clients and practitioners in a quick and sufficient way.

Figure 5:
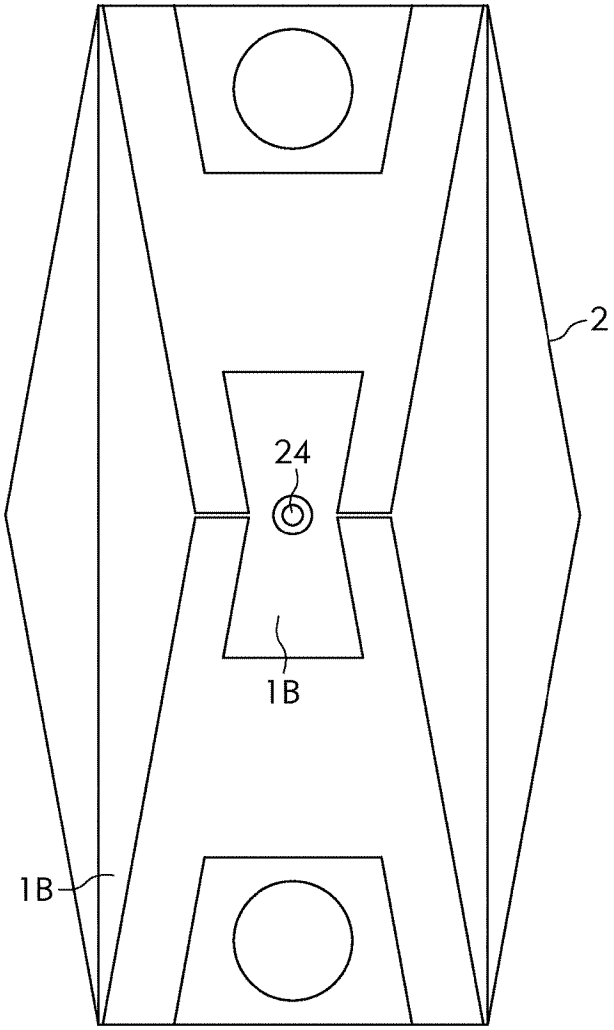
FIG. 5 is a view of the back side of the massage table with the triangular "wings" folded out.
Figure 8:
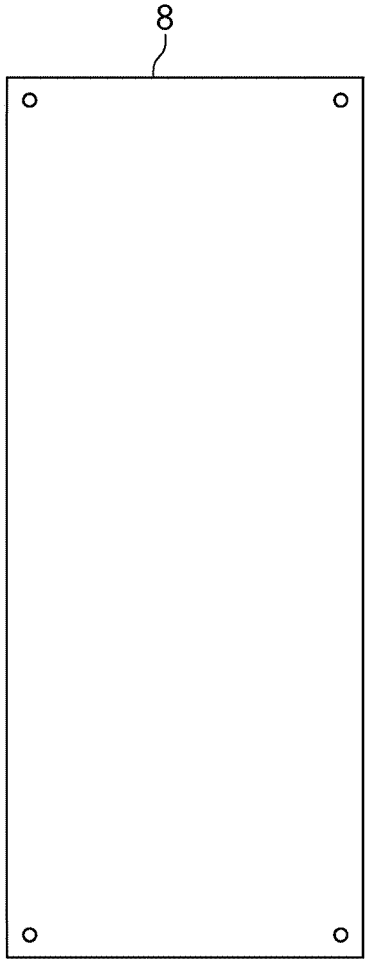
FIG. 8 is a view of the front of the exercise portion of the wall unit.
Figure 7:
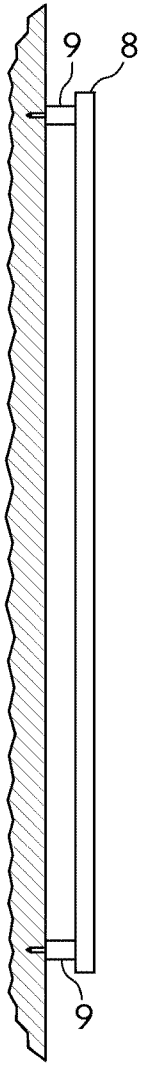
FIG. 7 is a side view of the exercise portion of the wall unit.

The arms or wings 2 are foldable or collapsible underneath the massage table 1 when not in use. In a preferable configuration, the arms or wings 2 of the massage table 1 can be folded under (FIG. 1), hang down at the side (FIG. 2), or extend to the side when in use (FIG. 5).

A set of wheels 23, similar in appearance to skateboard or track wheels, are located on each side of the massage table 1 at a front portion. Tracks 22 located on an inside front of the wall frame unit 21 receive the wheels 23 to enable the massage table 1 to slide up and down the unit 21 for storage or use. The table 1 can remain attached to the tracks 22 of the wall unit 21 for extra stability and safety during use or be removed for use apart from the wall unit 21. For added stability while in use and not attached to the wall frame unit, additional legs and/or a stabilizing cable system can be used, such as a screw or "click in" mechanism.

As shown in FIGS. 7-15, the exercise portion 8 of the wall unit 21 comes in two preferred embodiments. The main body of the exercise portion 8 consists of one finished plywood or synthetic board 8 and several wall mounting screws 9 which attach it to the wall unit 21 where it fits inside of the wall unit 21. In one preferred embodiment (FIGS. 11-15), the board 8 includes two long metal tracks 12, which accommodate a cable/pulley system unit 15, 17, and 26. The main part of the cable/pulley system unit 15,17, and 26 is the moveable carriage 16 at the mid-section of the tracks 12. It includes one ball bearing wheel 16*a* that slides within the track 12, one large metal washer ring to which the resistance spring 13 is removably attached. Two ball bearing pulley wheels 17 are attached to the moveable carriage 16 using either a short weight peg 18 for one weight plate 14 or a longer peg 19 if more weight plates 14 are needed for training.

There are two additional ball bearing upper pulley wheels 17 at the top of the main body which connect, through a long cable 15 to the mid-section pulley wheels 17 affixed to the moveable carriage 16. The top of the exercise portion 8 includes a rotating metal arm 26 configured to hold the upper pulley wheels 17. The cable 15 loops around the various pulleys 17 and ends at the upper pulley wheels 17 where one end is fixed and the other end is securely connected to foot/hand loops 20. In use, a person would hold onto or attach the loops to their hands, arms, feet, legs or with an additional strap around the body. The other end of the cable 15 is permanently attached within the frame and held in place securely by an end attachment.

In a slight variation of the above construction (FIGS. 13 and 15), additional lower pulley wheels 17 on a lower rotating metal arm 26 is included on the lower end of the track 12. The cable 15 may also be looped through these lower pulley wheels 17 and be connected to a second set of foot/hand loops 20. To accommodate this lower set of pulleys, opposite ends of the cable 15 are now connected to the top and the bottom of the unit 8, as opposed to being fixed at the top. This allows for simultaneous resistance training of the upper and lower body possible. Weight bearing and non weight bearing movements within all planes and directions of physical movement by the human body can be performed.

The use and combination of weight plates 14 within the tracks 12 attached to resistance springs 13 within the exercise unit 8 gives a wider range of resistance possibilities for each exercise. This makes it possible to experience the many layers of resistance training of the physical body on all levels within one exercise unit. It opens up multiple ways to train and teach within therapeutic work as well as making it possible to learn true health maintenance training through deeper awareness. The soft glide of the pulley system's ball bearing wheels 16*a* in the metal tracks 12 makes weight bearing exercise seem more natural and light. This in return enables the client's physical body to remain in a connected state throughout the movement session without any gripping of the muscles or joints.

The nickel plated resistance springs 13 offer more resistance at the strongest point of muscle contraction and less resistance at the starting and finishing point. This addresses mostly the superficial muscles within the physical body especially when medium to strong resistance is applied. The use of light weight plates 14 with the pulley wheels 17 and the cable 15 in combination with the smooth glide of the ball bearing wheels 16*a* produces an even resistance and makes it possible to activate the internal connective muscle groups (muscles along the skeletal system and all smaller muscle groups). The nickel plated steel resistance springs 13 may come in a variety of colors (yellow, blue, red) to indicated a range of resistance from light, to medium, to heavy.

In combining both, weight plates 14 and resistance springs 13, a different type of resistance is produced that enables the communication between internal and external muscle groups within the physical body connecting the "in between". The user can feel and learn the different sensations this produces within their own physicality and apply this new understanding more easily into their daily life.

In an alternate embodiment (FIGS. 8-10), the exercise portion may be replaced by a storage portion which again consists of one finished plywood board or synthetic board 8 and wall mounting pegs 9 for attachment to the wall. In this embodiment, the board 8 includes multiple horizontal slots 10 for the storage of towels or sheets and includes an extra metal framed horizontal slot 11 for hanging product bags and providing shelf storage. Not only can everything be stored and kept together in one but this also gives an instant organized appearance when the massage table 1 is in the standing position.

The wall unit may be configured to include either the exercise portion or the storage portion so as to suit their particular needs. For example: a Pilates instructor might choose a wall frame unit 21 with an exercise portion if clients may be performing weight or resistance training. Conversely a massage therapist might choose a wall frame unit 21 with the storage portion for ease of access to towels, sheets, and other storage. Because of the use of wall mounting screws 9, the exercise portion and storage portion may be switched after installation.

Figure 10:
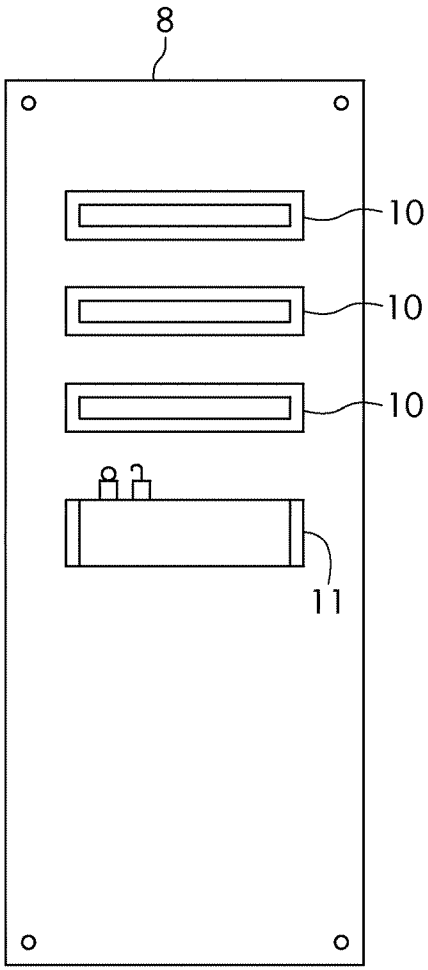
FIG. 10 is a front view of an alternate embodiment of the exercise portion of the wall unit.
Figure 9:
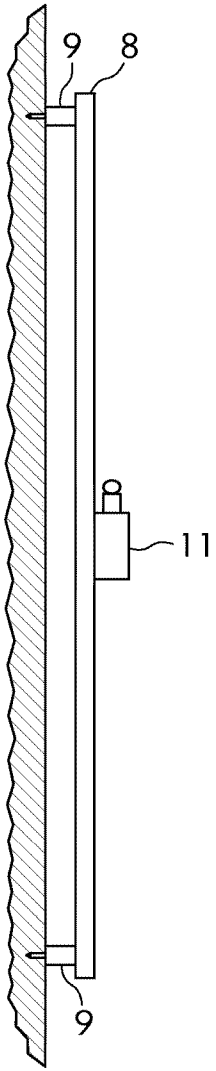
FIG. 9 is a side view of an alternate embodiment of the exercise portion of the wall unit.
Figure 11:
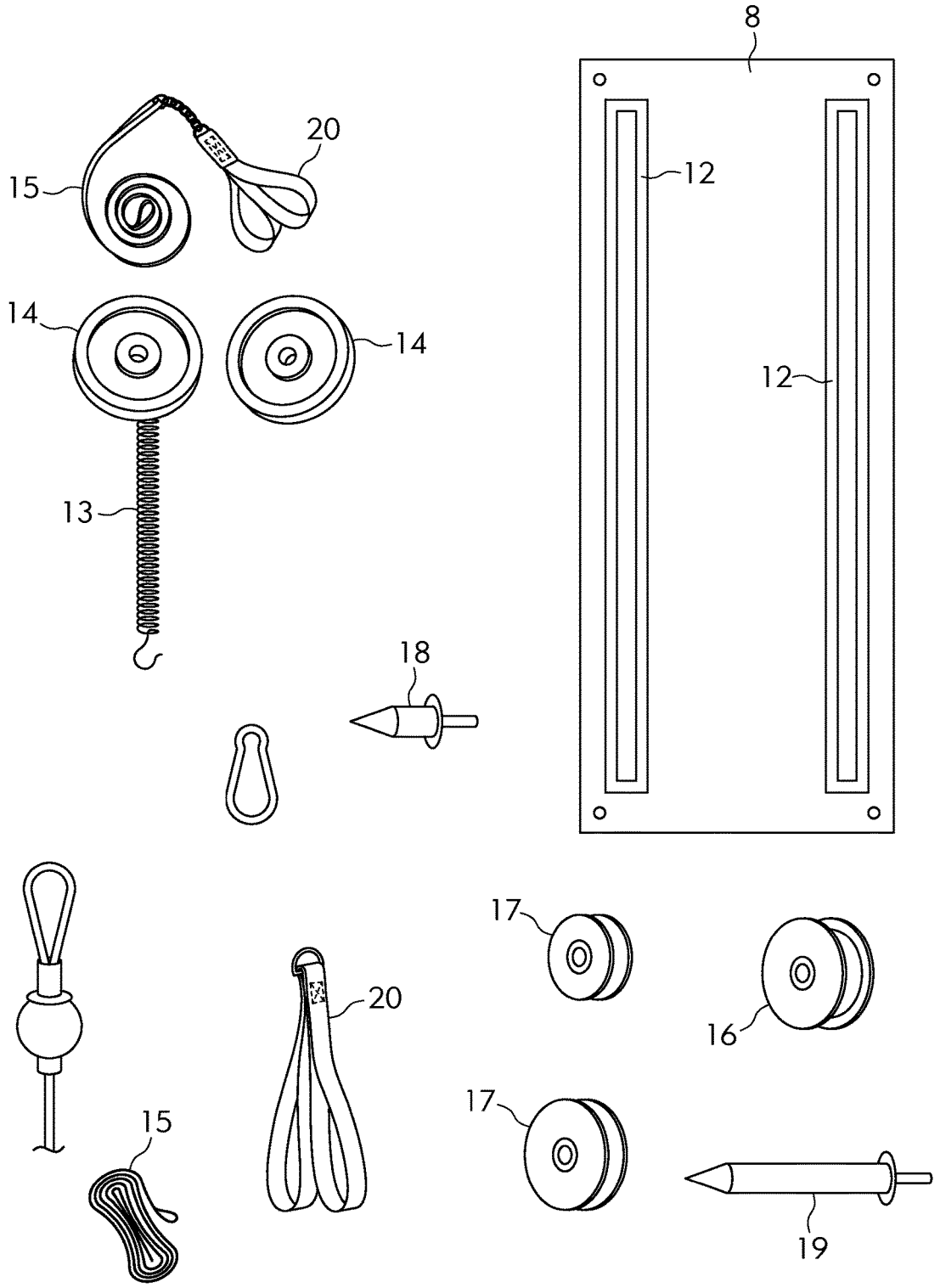
FIG. 11 shows the main components used for the pulley/weight exercise portion of the wall unit.
Figure 12:
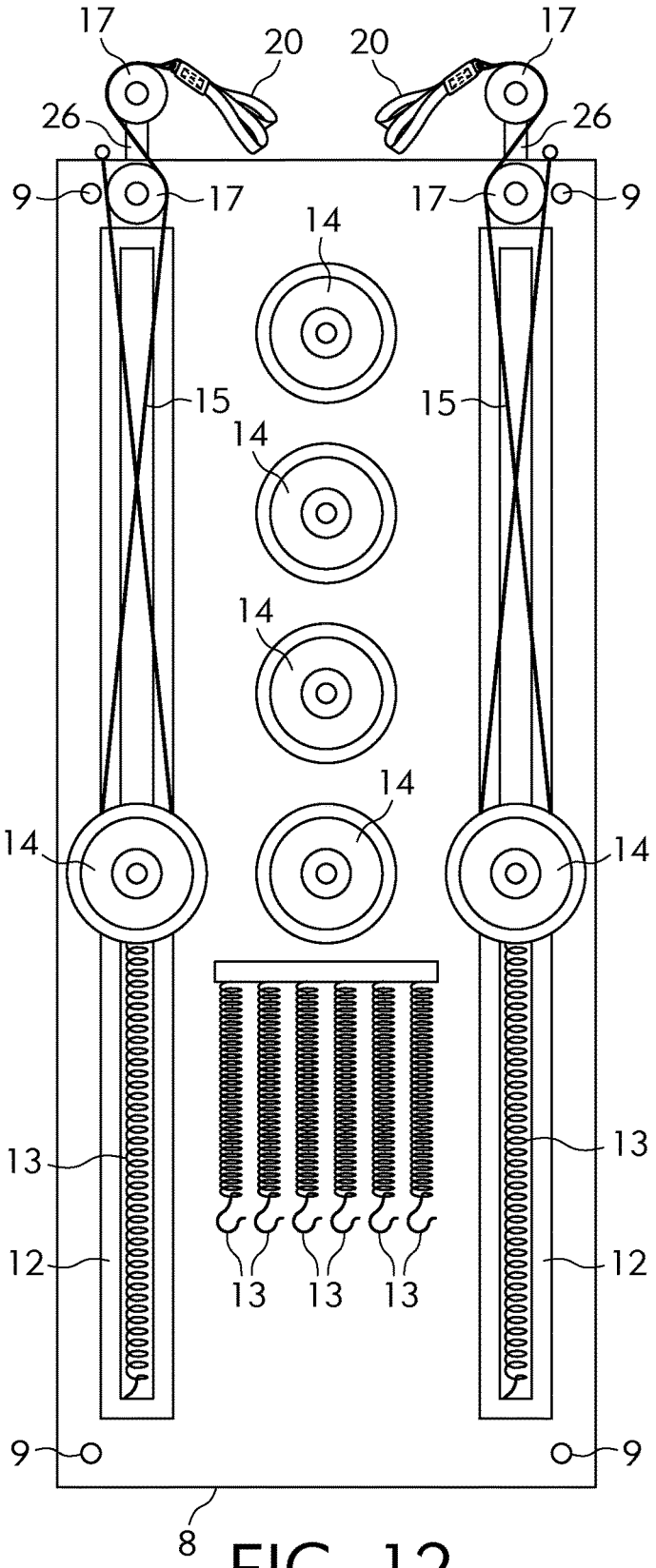
FIG. 12 shows the front view of the exercise portion of the wall unit and its main components of the pulley/weight and spring resistance system.
Figure 13:
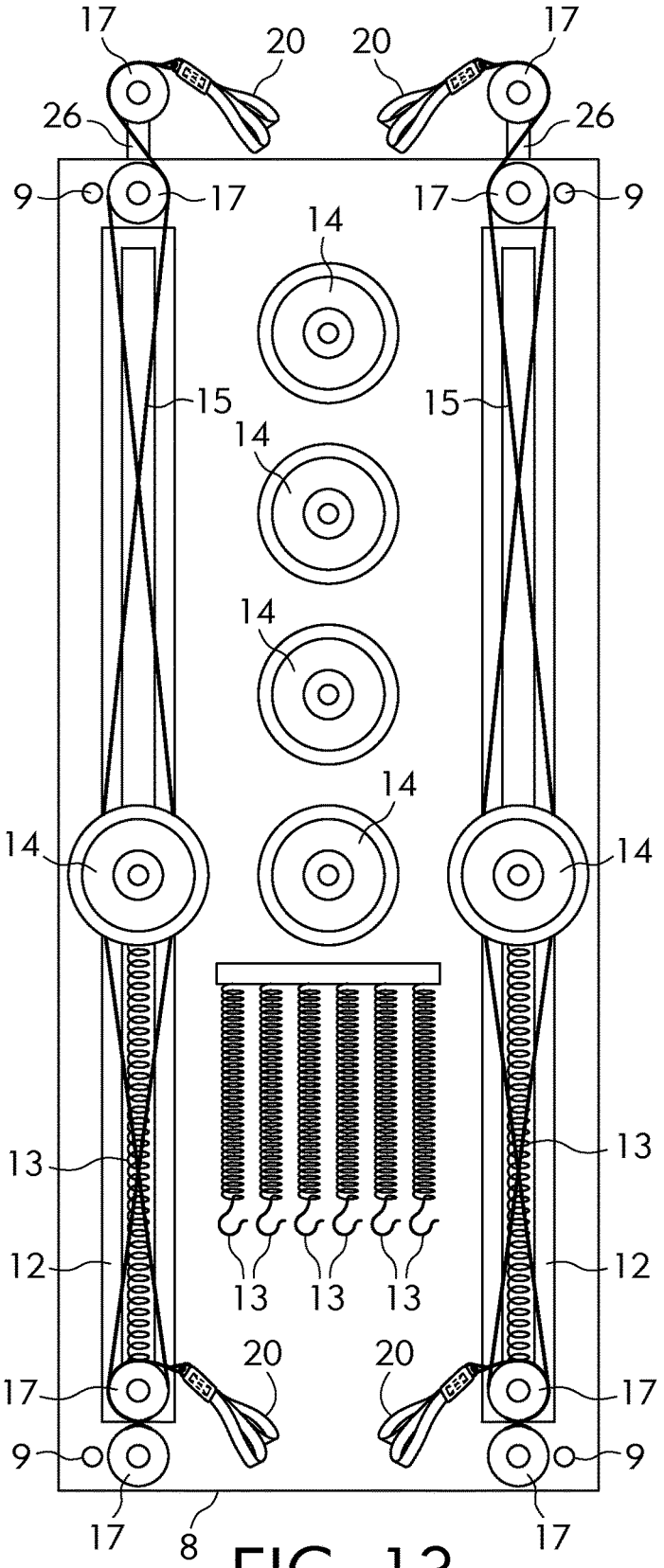
FIG. 13 is a front view of an alternate embodiment of the assembled pulley/weight exercise portion of the wall unit and its main components of the pulley/weight and spring resistance system.
Figure 14:
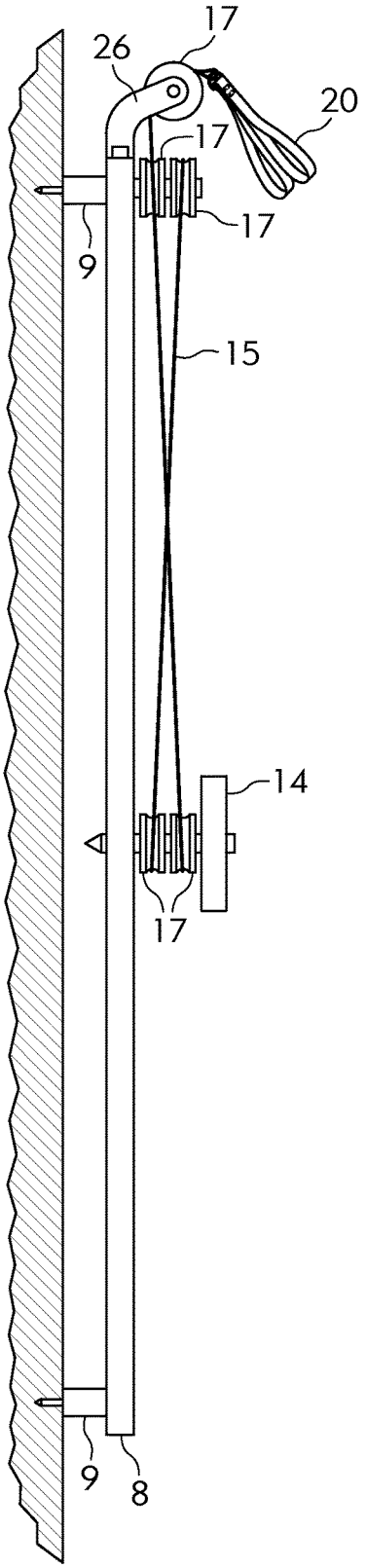
FIG. 14 is a side view of the exercise portion of the wall unit of FIG. 12.
Figure 15:
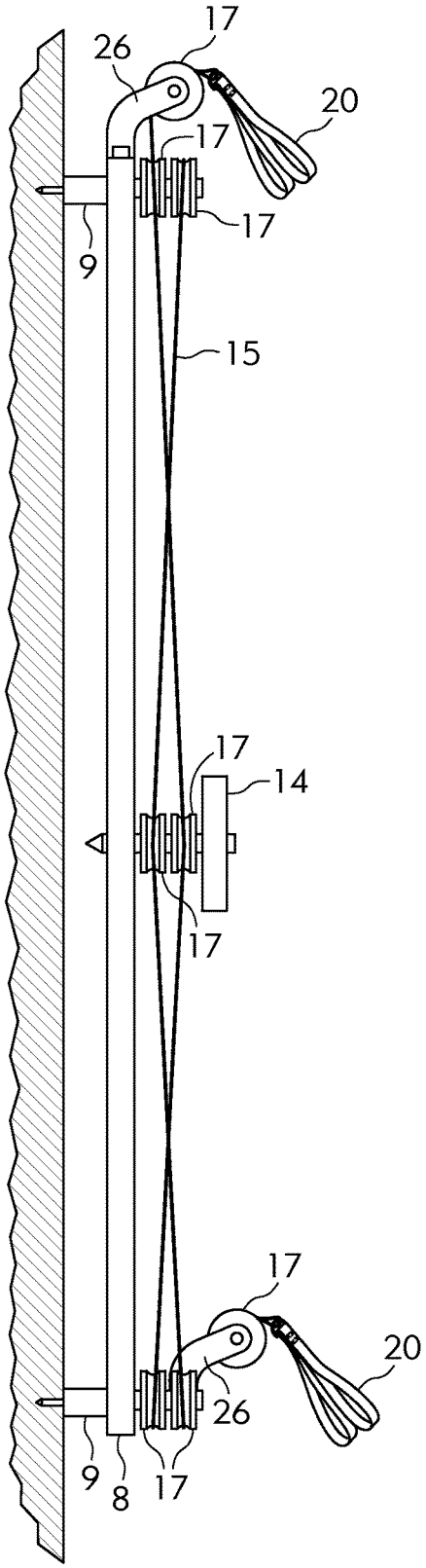
FIG. 15 is a side view of the exercise portion of the wall unit of FIG. 13.
Figure 17:
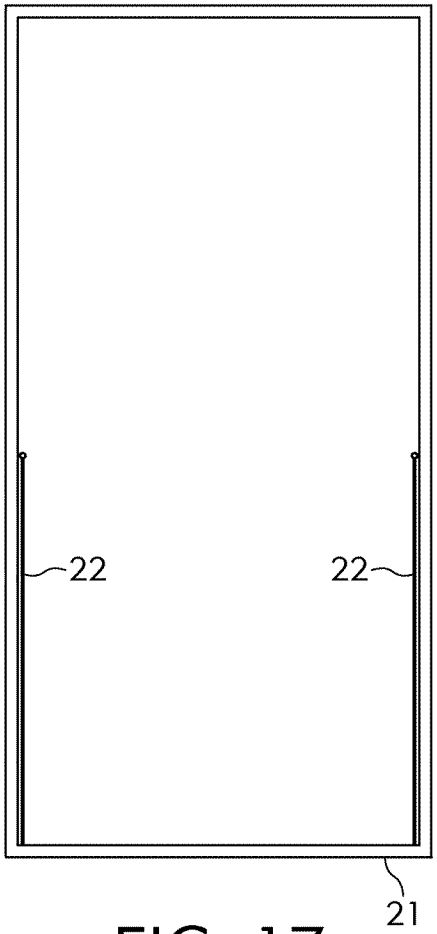
FIG. 17 is a view of the front of the wall unit frame.
Figure 16:
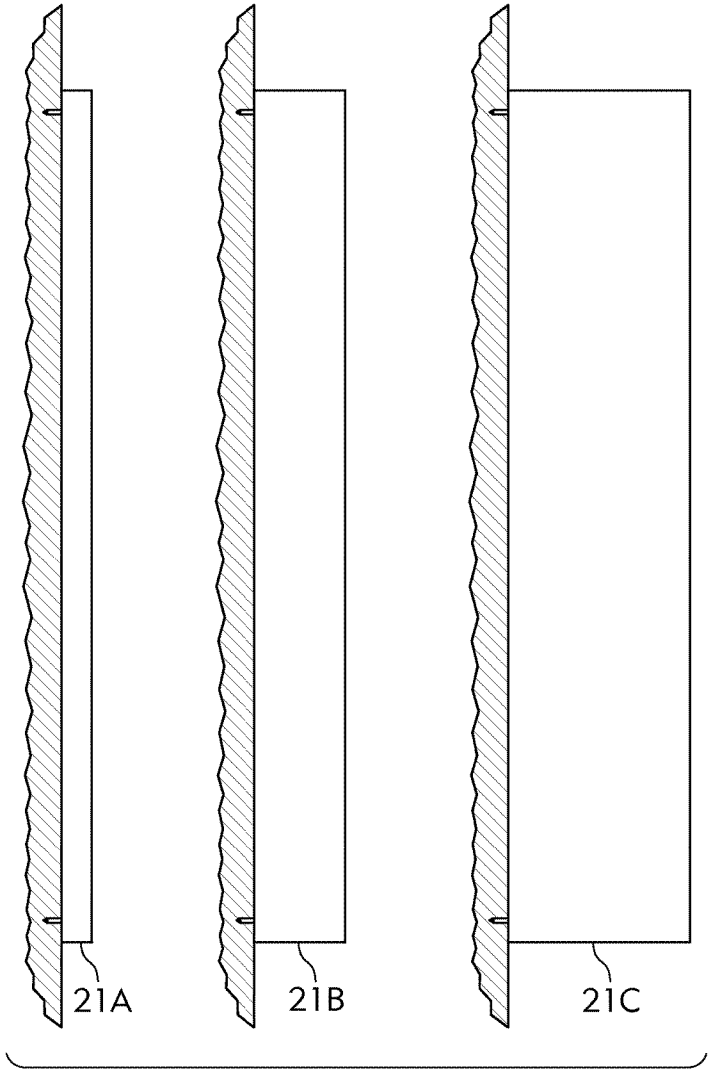
FIG. 16 is a side view of various depths of the wall unit frame.
Figure 18:
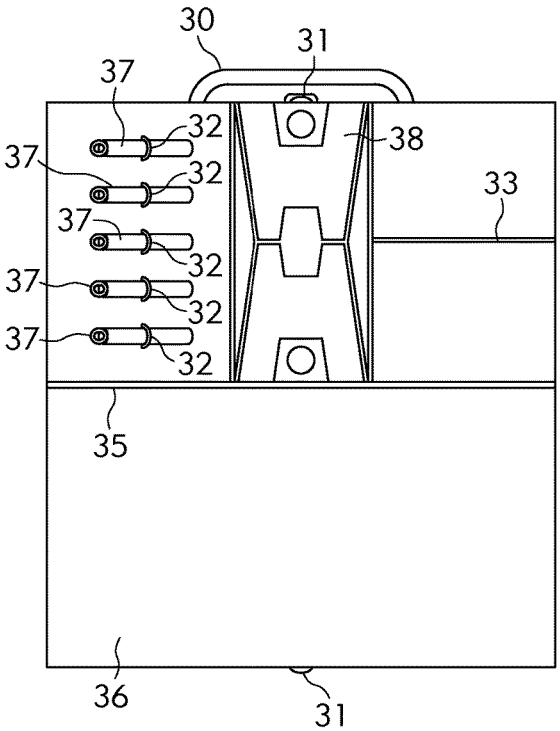
FIG. 18 is a schematic illustration of a toy version of the massage table and wall unit and storage case.

As shown in FIGS. 16 and 17, the wall unit 21 may be provided in varying depths (21A, 21B, 21C) depending upon whether the exercise portion or storage portion is being used. The wall frame unit 21 is preferably made out of four finished plywood pieces or synthetic board and is attached directly to the wall. The smallest depth 21A is preferably about six and one-half inches deep, which is suitable to store the massage table unit only. The medium depth 21B is preferably about eleven inches deep, which is a suitable size for storing the massage table unit and storage portion (FIG. 10). The deepest depth 21C is preferably twelve and one-half inches deep, which is suitable for storing the massage table unit and the exercise portion.

FIG. 17 it illustrates a front view of the wall frame unit 21 with the metal tracks 22 for accepting the wheels 23 of the massage table 1. The main function of the metal track 22 is to hold the massage table 1 in place when stored into the wall frame unit 21. The storage of the massage table 1 also covers the exercise portion or storage portion when installed in the wall unit 21, which helps to keep the system dust free when not in use, as well as, giving an organized compact appearance when all components are stored inside. +

A bar attachment which is one of the optional accessories can fix both mid pulley components (within a small space where the weight plate is attached 14, 17 of the right and left track 12 so that simultaneous exercises can be taught and performed. Without the bar attachment, the right and left pulley weights move individually producing a wider range of multiple variations of exercising possibilities.

Figure 28:
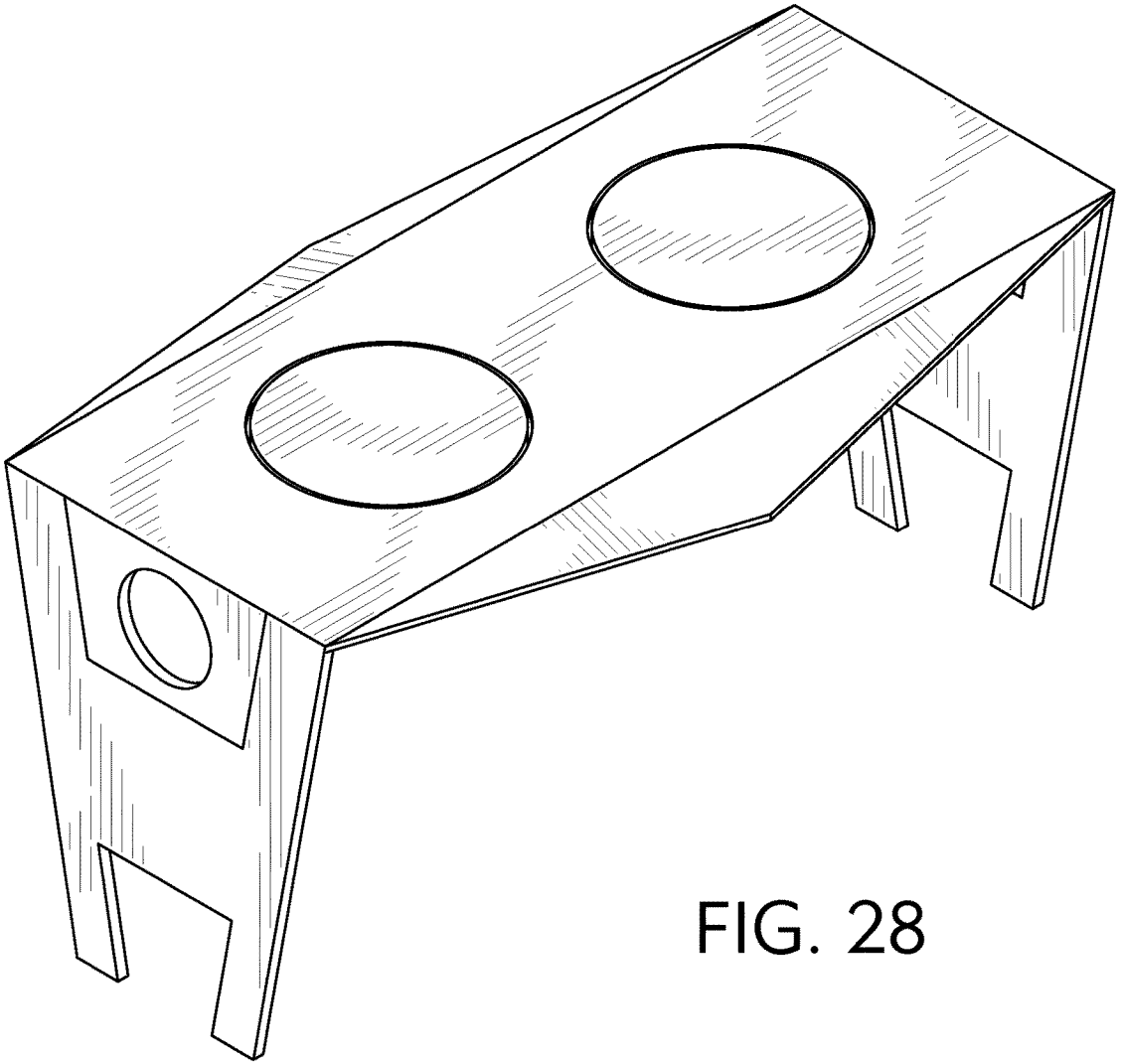
FIG. 28 illustrates the massage table with 2 rotator disc on the top surface of the table within its main body.

Another option is rotator discs which can be installed the upper surface of the massage table 1 (FIG. 28). This is another therapeutic advantage of the massage table 1. The rotator discs rotate through a range to enable deeper core training during weight bearing exercises as well as mobilization training of the spine, which is especially valuable for the related fields of rehabilitation and pro sport training.

Round foam cushions can be placed into the round face opening of the headrests 7 located at opposite ends of the massage table unit, to create an even surface for the back of the head while resting on it (optional) during supine positions.

Due to the simple and compact design it is also suitable for the toy market. In FIGS. 18-23C are examples of a toy play set relating to a "Body and Mind" studio as would be used with dolls or other figures. The toy system includes features to some of the more popular movement systems such as Pilates, Yoga, as well as, a Spa, all made to fit for small dolls. This teaches children in a playful way to use their fine motoric, interaction skills as well as storytelling. In return this can inspire children to do sports and be more interested in a healthful life.

Figure 22:
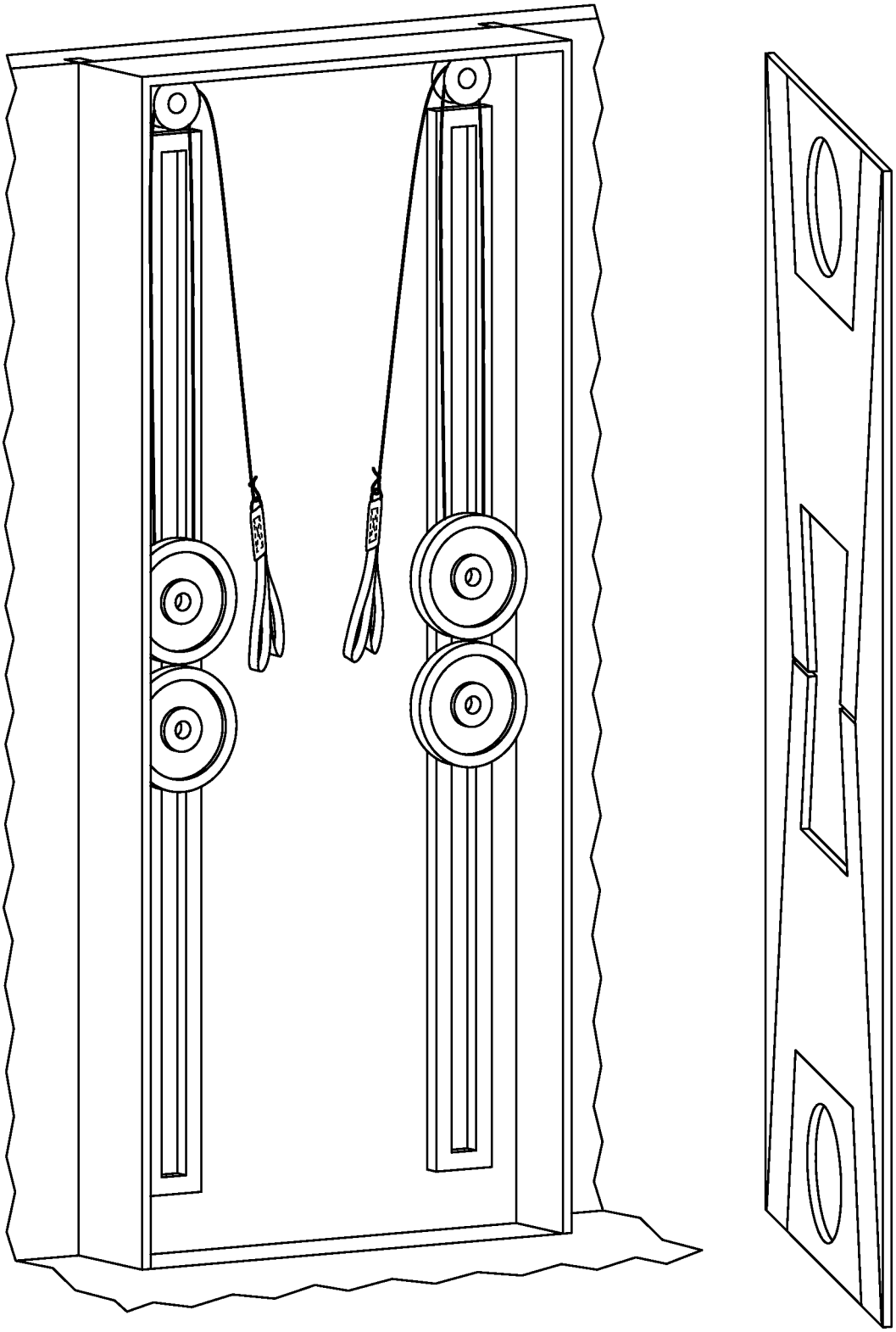
FIG. 22 illustrates the exercise portion of the wall unit and separated massage table from the toy version.

It's easy versatile set up of all components includes a toy case 36 that contains a toy massage table 38 similar in structure and appearance to the full size massage table 1. The toy table 38 unfolds and folds back into itself and is kept in place by small magnets or other securing mechanisms within the back side of the toy furniture's main body (FIG. 22). The toy table 38 may slide in and out of the toy case 36 through two slots 34.

Figure 19:
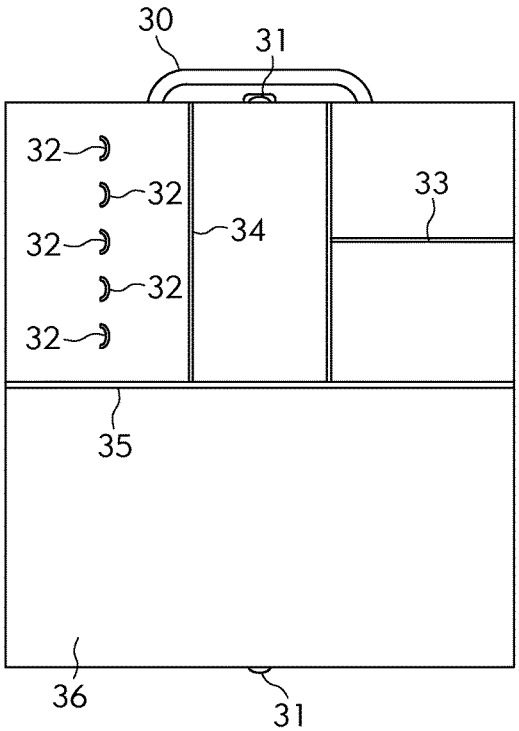
FIG. 19 is another schematic illustration of the toy version opened up, showing the toy's "Body and Mind" studio without accessories.
Figure 20:
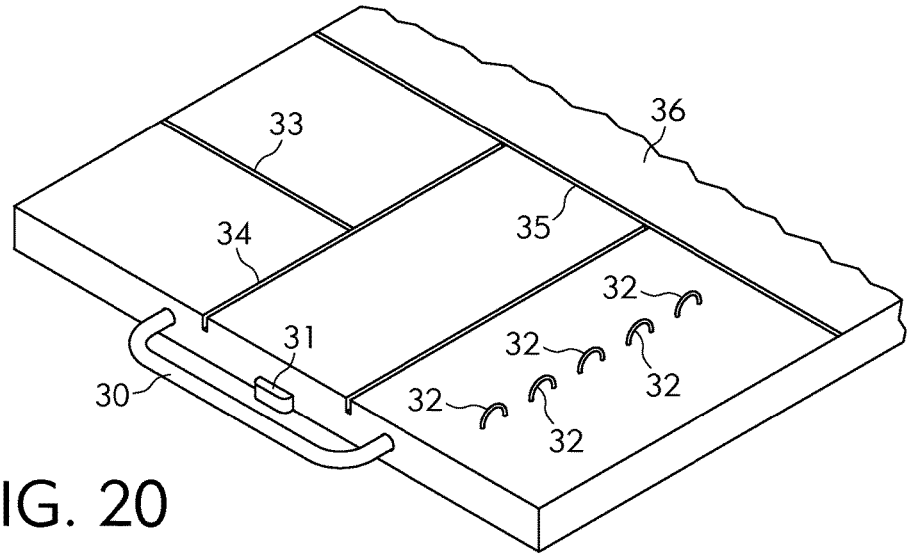
FIG. 20 is another schematic illustration of the toy version illustrating tracks for sliding the toy version into the case.

The toy version may also include a ballet bar 33 to one side and a plurality of yoga mat attachment rings 32 and yoga mats 37 to the other side. When these components are stored, the case 38 can be completely closed and locked through locking clasps 31. The handle 30 allows for carrying the case 38. The case 38 can be put into three positions: closed, at 90 degrees for simulating an environment while playing (FIGS. 18 and 21), and at 180 degrees for laying flat (FIGS. 19 and 20).

Figure 21:
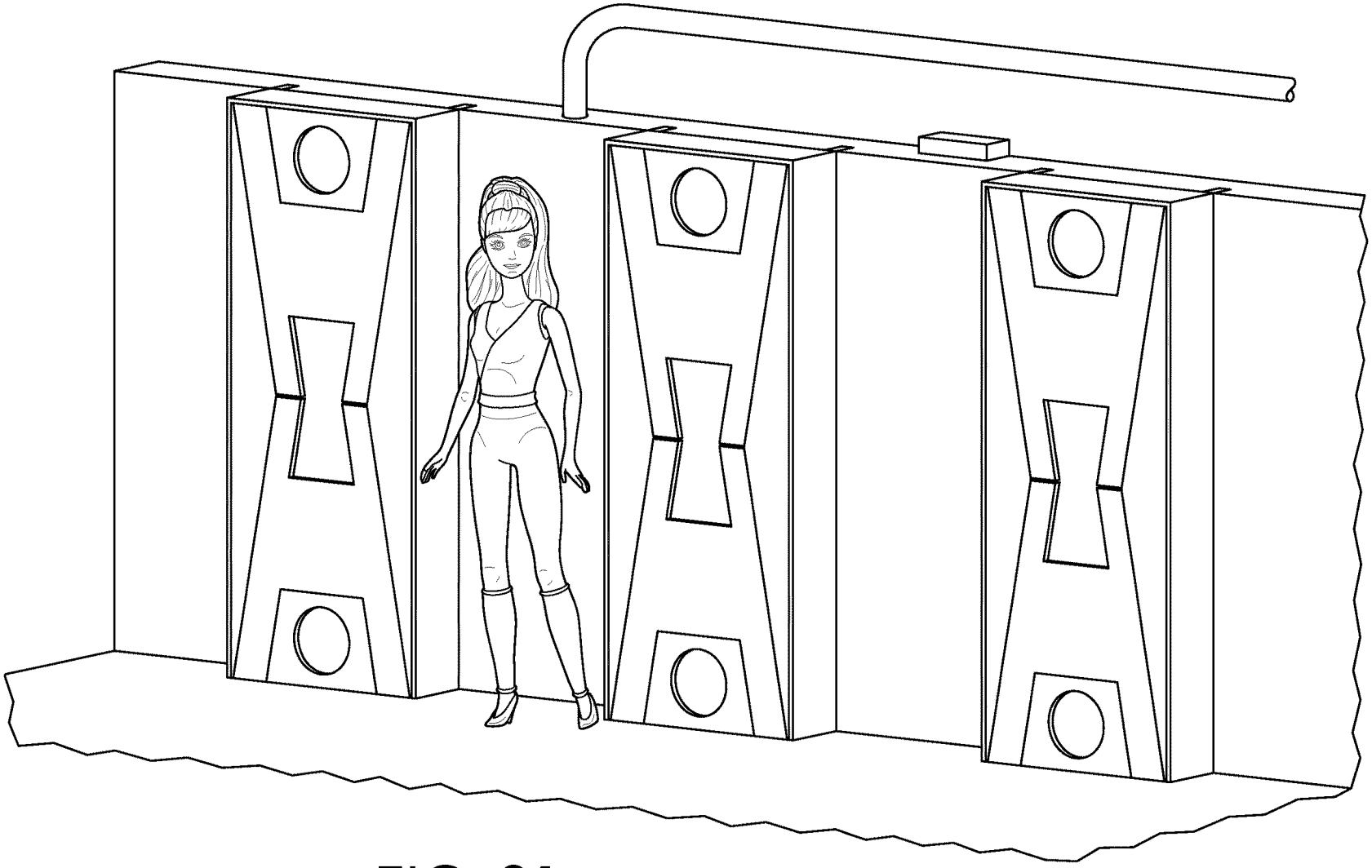
FIG. 21 illustrates a larger version of the play board for sliding in multiple toy versions of the massage table and wall unit.
Figure 23A:
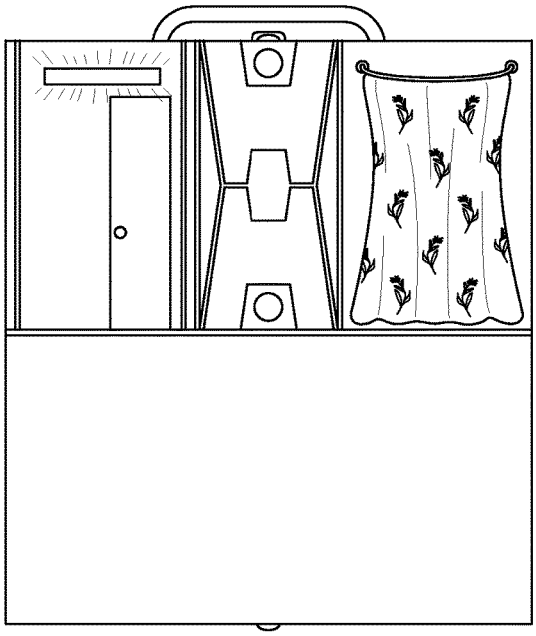
FIG. 23A schematically illustrates a front view of the toy version of a spa incorporating the massage table and wall unit and other accessories.
Figure 23B:
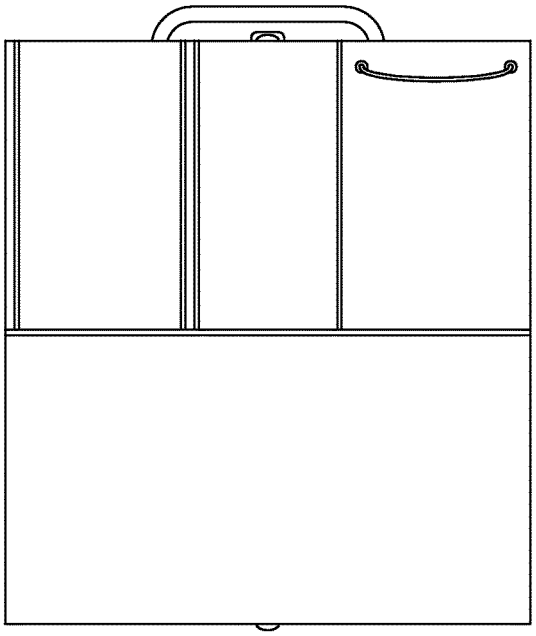
FIG. 23B schematically illustrates a front view of an open carrying case for the toy version without the massage table and wall unit, or any accessories.
Figure 23C:
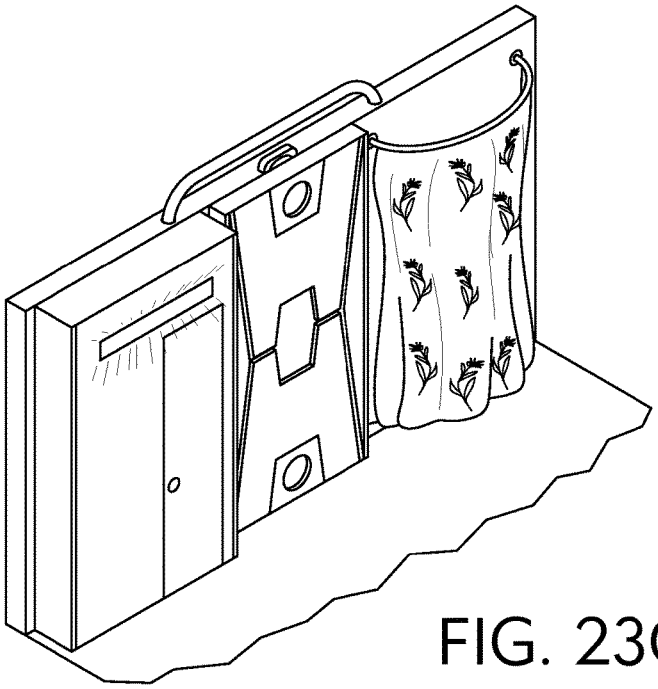
FIG. 23C shows a perspective view of the toy version of the spa from FIG. 23A.

FIG. 21 shows an alternate configuration of the case 38 including multiple slots in which three toy versions of the table 38 are displayed in their folded up state within their frame box. This is a version of a bigger play studio for the dolls. One doll stands in between the first two boxes. FIG. 22 shows a perspective view of the invention's massage table unit folded up and the exercise system visible within the frame box. FIG. 23A shows a front view of the Invention's toy version of a small doll's Toy Spa with the toy version of the invention and a view of its accessories such as an infrared/color light toy sauna, shower with cloth or plastic curtain. Other variations on a spa may be incorporated into this toy version. FIG. 23B shows the invention's carrying case in a 180 degree open position without the toy version of the invention or any accessories. FIG. 23C shows a perspective view of the invention's toy spa version.

Figure 24:
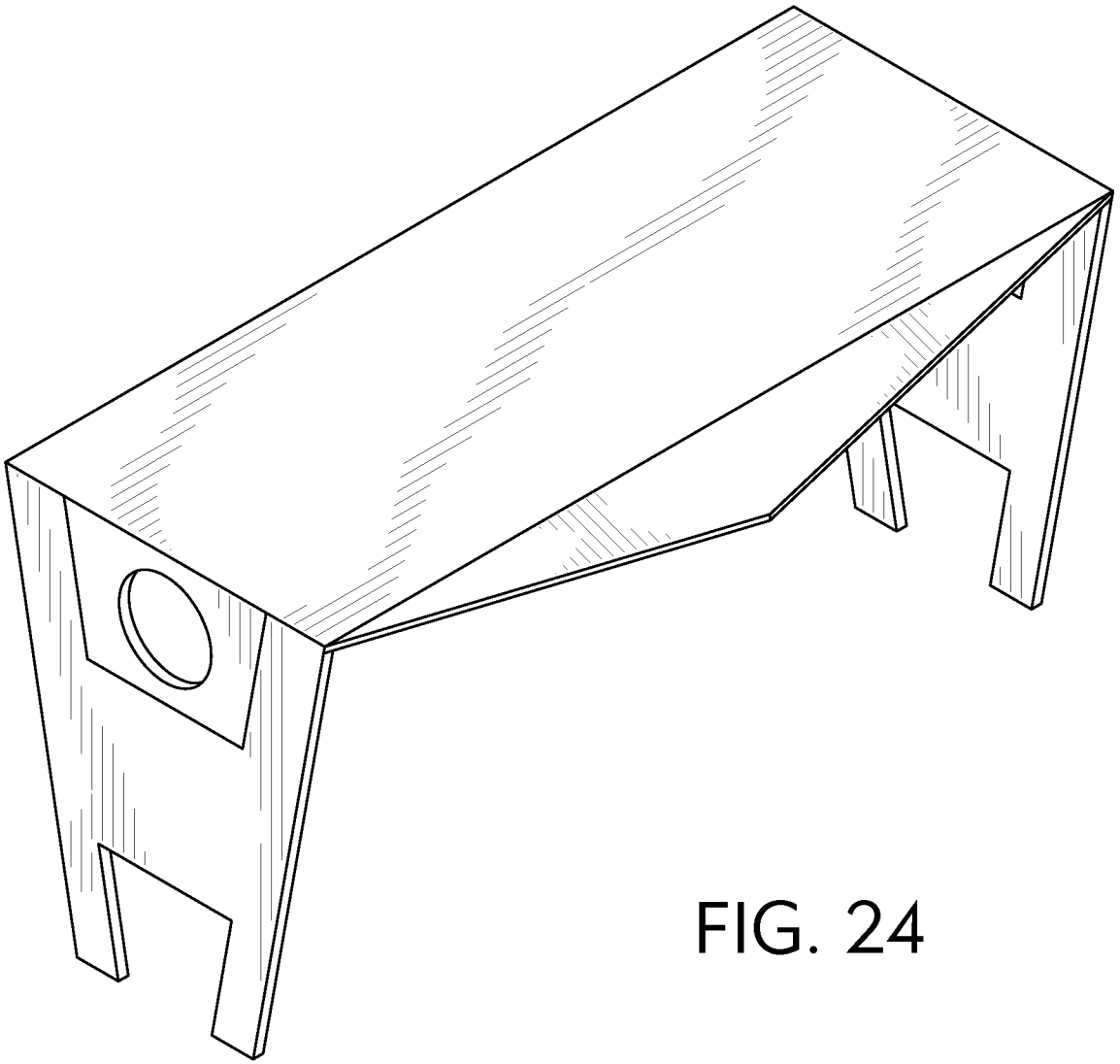
FIG. 24 shows a perspective drawing of the massage table with one triangular arm extended.
Figure 25:
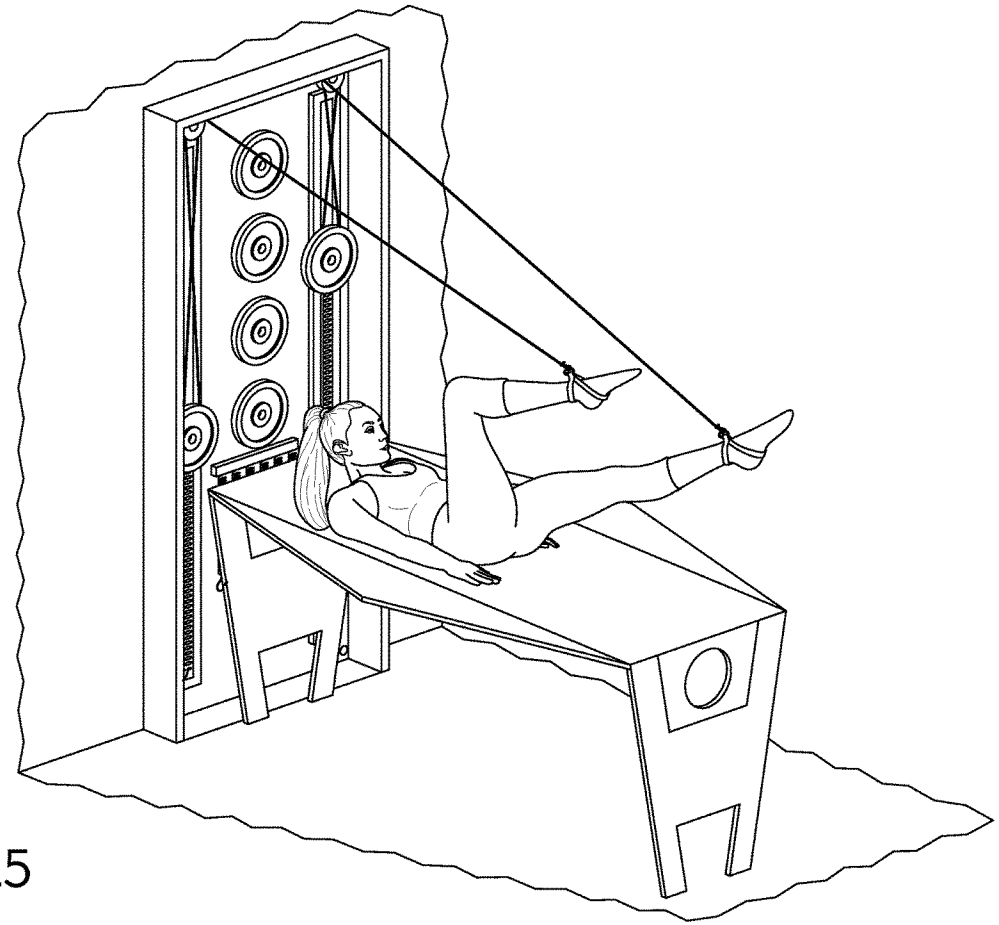
FIG. 25 illustrates and environmental view of the massage table and wall unit with exercise portion being used by a person.
Figure 27:
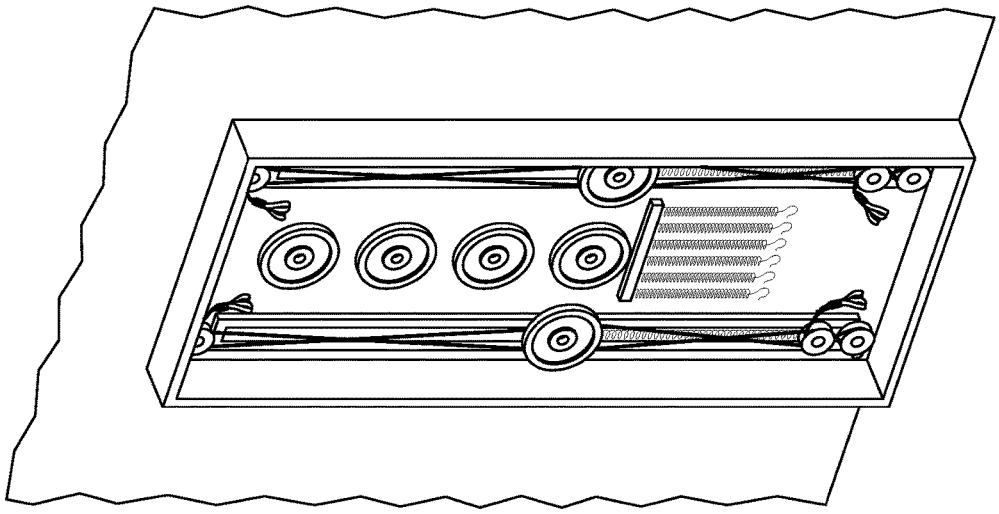
FIG. 27 illustrates the exercise portion of the wall unit.
Figure 26:
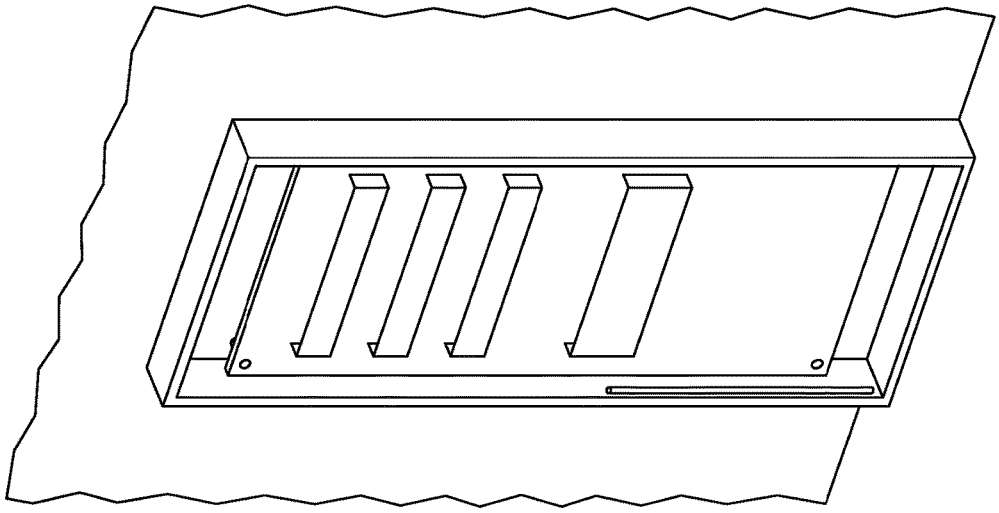
FIG. 26 illustrates the alternate embodiment of the exercise portion of the wall unit with separable massage table.

Returning to the full size version, FIG. 24 shows a perspective view of the massage table unit 1 with one triangular arm 2 extended. FIG. 25 shows an environmental illustration of a person using the massage table 1 with exercise portion of the wall unit 21. The person exercising is laying supine and using the top foot/hand loops attached at their feet using a combination of one weight plate and two resistance springs. FIG. 26 shows the wall unit 21 with storage portion. FIG. 27 shows the wall unit 21 with exercise portion. A massage table 1 is shown separate from the wall frame unit 21 and in both FIGS. 26 and 27.

FIG. 28 shows a perspective view of the massage table unit 1 with two rotator discs built into the upper surface of the main body. This unit is used mainly for therapy and pro sport, as described above.

Figure 29:
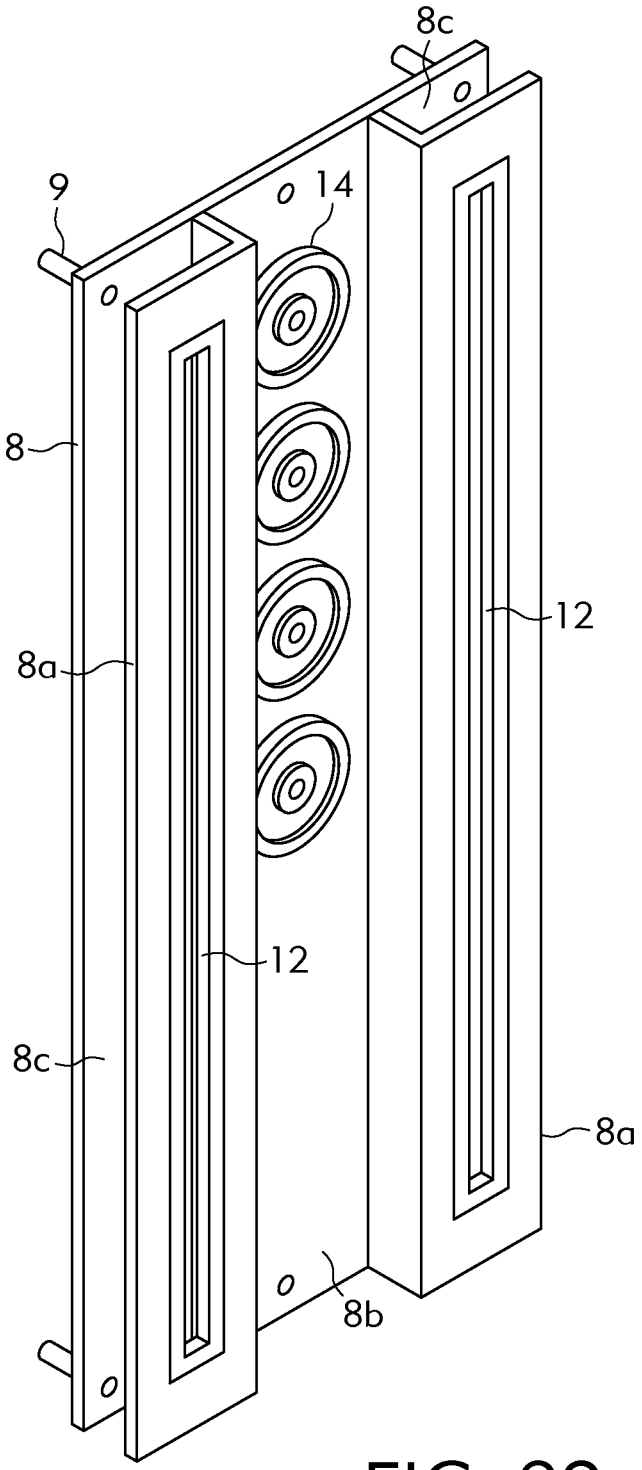
FIG. 29 illustrates an alternate embodiment of the mounting of the exercise tracks in the exercise unit.
Figure 30:
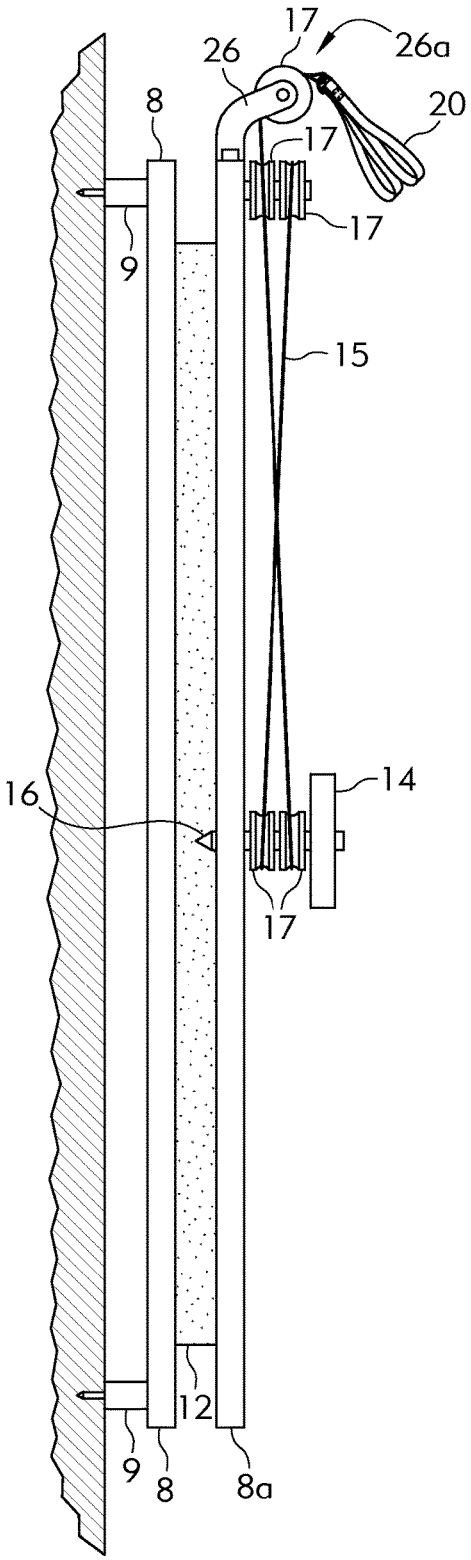
FIG. 30 is a side view of the exercise portion of the wall unit of FIG. 29 with a cable and pulley system similar to FIG. 12.
Figure 31:
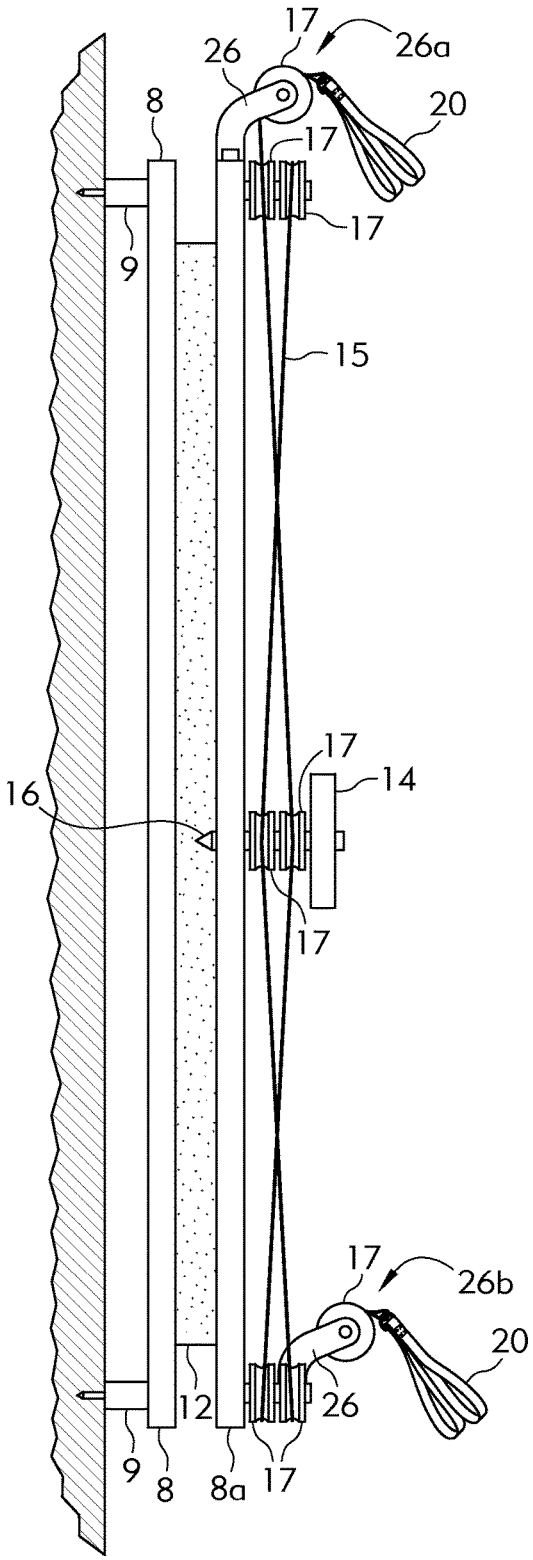
FIG. 31 is a side view of the exercise portion of the wall unit of FIG. 29 with a cable and pulley system similar to FIG. 13.

FIGS. 29-31 illustrate an alternate embodiment of the cable and pulley exercise unit. In this alternate embodiment, metal exercise tracks 12 are mounted on raised platforms 8*a* mounted to either side of a central storage area 8*b* on the exercise unit board 8. The raised platforms 8*a* create an operating area 8*c* behind the raised platforms 8*a*. Weight plates 14 can be stored in the central storage area 8*b*. Because the platforms 8*a* are raised relative to the board 8, the weight plates 14 stored in the central storage area 8*b* are less likely to interfere with a person using the exercise unit or the operation of the cable and pulley system. FIGS. 30 and 31 illustrate this alternate embodiment in side view with the moveable carriage 16 attached to either a single upper pulley system 26*a* (FIG. 30) or to both an upper pulley system 26*a* and a lower pulley system 26*b* (FIG. 31).

The invention allows greater mobility and accessibility in facilitating more efficient and versatile movements during a training/treatment session in an elegant compact, space saving way as well as a fun learning toy for children in its miniature form.

Although several embodiments have been described in detail for purposes of illustration, various modifications may be made without departing from the scope and spirit of the invention.

What is claimed is:

1. An exercise and massage treatment table system, comprising:

a generally rectangular housing unit configured to be secured to a vertically oriented surface, the housing unit having an interior compartment;

a pair of guide tracks mounted to opposite side walls of the interior compartment, wherein each guide track has a first end adjacent to a bottom of the side walls and a second end adjacent to an approximate mid-point of the side walls;

a massage table having a generally planar surface that approximates a size and shape of the interior compartment of the housing unit;

a pair of legs hingedly attached to opposite first and second end edges of the massage table, wherein each of the pair of legs are independently configured to pivot approximately ninety degrees between a closed position generally parallel to the planar surface against an underside of the massage table and an open position generally perpendicular to the planar surface;

a headrest hingedly attached to one of the first or second end edges of the massage table aligned with a headrest cut-out on one of the pairs of legs, wherein the headrest is configured to pivot approximately one hundred eighty degrees between a closed position generally parallel to the planar surface against the underside of the massage table within the headrest cut-out and an open position generally parallel to the planar surface extending away from the end edge to which the headrest is hingedly attached; and a pair of wheels rotatably attached to opposite sides of the first end edge of the massage table, wherein each of the pair of wheels are configured to slidably engage a respective one of the pair of guide tracks in the interior compartment.

2. The exercise and massage treatment table system of claim 1, wherein the massage table is slidably movable within the housing unit between a storage position and a standing position, in the storage position the massage table fits within the interior compartment and the pair of wheels are engaged with the first end of the pair of guide tracks, and in the standing position the massage table extends outward from the interior compartment and the pair of wheels are engaged with the second end of the pair of guide tracks.

3. The exercise and massage treatment table system of claim 2, wherein the massage table further has a removed position such that the pair of wheels are separated from the pair of guide tracks.

4. The exercise and massage treatment table system of claim 2, wherein each of the pair of legs includes a lower extension that is adjustable in length so as to adjust a height of the planar surface from a floor when in the standing position.

5. The exercise and massage treatment table system of claim 1, wherein the planar surface of the massage table comprises a rotator disc configured to rotate through a range of motion during exercise.

6. The exercise and massage treatment table system of claim 1, further comprising a storage unit mounted on a back wall of the housing unit within the interior compartment, wherein the storage unit presents a vertical wall having a plurality of slots configured to receive towels or sheets.

7. The exercise and massage treatment table system of claim 6, wherein at least one of the plurality of slots has a metal frame shelf.

8. The exercise and massage treatment table system of claim 1, further comprising a case in which the housing unit is secured, such that the exercise and massage treatment table system is transportable within the case.

9. An exercise and massage treatment table system, comprising:

a generally rectangular housing unit configured to be secured to a vertically oriented surface, the housing unit having an interior compartment;

a pair of guide tracks mounted to opposite side walls of the interior compartment, wherein each guide track has a first end adjacent to a bottom of the side walls and a second end adjacent to an approximate mid-point of the side walls;

a massage table having a generally planar surface that approximates a size and shape of the interior compartment of the housing unit;

a pair of legs hingedly attached to opposite first and second end edges of the massage table, wherein each of the pair of legs are independently configured to pivot approximately ninety degrees between a closed position generally parallel to the planar surface against an underside of the massage table and an open position generally perpendicular to the planar surface;

a pair of side platforms hingedly attached to opposite first and second side edges of the massage table, wherein each of the pair of side platforms are independently configured to pivot approximately one hundred eighty degrees between a closed position generally parallel to the planar surface against the underside of the massage table and an open position generally parallel to the planar surface extending away from the side edge to which the side platform is hingedly attached; and a pair of wheels rotatably attached to opposite sides of the first end edge of the massage table, wherein each of the pair of wheels are configured to slidably engage a respective one of the pair of guide tracks in the interior compartment.

10. The exercise and massage treatment table system of claim 9, wherein each of the pair of side platforms are independently configured to engage a middle position approximately ninety degrees from either the closed position or the open position, generally perpendicular to the planar surface.

11. The exercise and massage treatment table system of claim 9, wherein the massage table is slidably movable within the housing unit between a storage position and a standing position, in the storage position the massage table fits within the interior compartment and the pair of wheels are engaged with the first end of the pair of guide tracks, and in the standing position the massage table extends outward from the interior compartment and the pair of wheels are engaged with the second end of the pair of guide tracks.

12. The exercise and massage treatment table system of claim 11, wherein the massage table further has a removed position such that the pair of wheels are separated from the pair of guide tracks.

13. The exercise and massage treatment table system of claim 11, wherein each of the pair of legs includes a lower extension that is adjustable in length so as to adjust a height of the planar surface from a floor when in the standing position.

14. The exercise and massage treatment table system of claim 9, wherein the planar surface of the massage table comprises a rotator disc configured to rotate through a range of motion during exercise.

15. The exercise and massage treatment table system of claim 9, further comprising a storage unit mounted on a back wall of the housing unit within the interior compartment, wherein the storage unit presents a vertical wall having a plurality of slots configured to receive towels or sheets.

16. The exercise and massage treatment table system of claim 15, wherein at least one of the plurality of slots has a metal frame shelf.

17. An exercise and massage treatment table system, comprising:

a generally rectangular housing unit configured to be secured to a vertically oriented surface, the housing unit having an interior compartment;

a pair of guide tracks mounted to opposite side walls of the interior compartment, wherein each guide track has a first end adjacent to a bottom of the side walls and a second end adjacent to an approximate mid-point of the side walls;

a massage table having a generally planar surface that approximates a size and shape of the interior compartment of the housing unit;

a pair of legs hingedly attached to opposite first and second end edges of the massage table, wherein each of the pair of legs are independently configured to pivot approximately ninety degrees between a closed position generally parallel to the planar surface against an underside of the massage table and an open position generally perpendicular to the planar surface;

a pair of wheels rotatably attached to opposite sides of the first end edge of the massage table, wherein each of the pair of wheels are configured to slidably engage a respective one of the pair of guide tracks in the interior compartment; and an exercise unit mounted on a back wall of the housing unit within the interior compartment, wherein the exercise unit presents a pair of exercise tracks that extend vertically along the exercise unit and accommodate a cable and pulley exercise system, wherein the cable and pulley exercise system has, a pair of upper pulleys mounted proximate to a to of each of the pair of exercise tracks and a pair of moveable carriages mounted in each of the pair of exercise tracks, wherein one of the pair of upper pulleys is connected by a cable to an associated one of the pair of moveable carriages on the same exercise track, such that when the cable is pulled or released through the upper pulley the associated moveable carriage moves in a corresponding direction along the exercise track, wherein each of the pair of moveable carriages is biased by a resistance spring to a bottom of the associated exercise track.

18. The exercise and massage treatment table system of claim 17, wherein the pair of exercise tracks are respectively mounted on raised platforms so as to form a central storage area between the raised platforms and an operating area behind each raised platform.

19. The exercise and massage treatment table system of claim 17, wherein each of the pair of moveable carriages includes a peg configured to receive weighted plates thereupon.

20. The exercise and massage treatment table system of claim 17, wherein the pair of upper pulleys are each mounted on one of a pair of rotating arms associated with one of the pair of exercise tracks.

21. The exercise and massage treatment table system of claim 17, wherein the cable and pulley exercise system further has, a pair of lower pulleys mounted proximate to a bottom of each of the pair of exercise tracks, wherein the cable also connects one of the pair of lower pulleys to an associated one of the pair of moveable carriages on the same exercise track.

22. The exercise and massage treatment table system of claim 21, wherein the pair of lower pulleys are each mounted on one of a pair of rotating arms associated with one of the pair of exercise tracks.

23. The exercise and massage treatment table system of claim 21, wherein each of the pair of moveable carriages is biased, relative to the pair of upper pulleys, by the resistance spring to the bottom of each of the pair of exercise tracks, and, relative to the pair of lower pulleys, by a top resistance spring to the top of each of the pair of exercise tracks.

24. The exercise and massage treatment table system of claim 17, wherein the massage table is slidably movable within the housing unit between a storage position and a standing position, in the storage position the massage table fits within the interior compartment and the pair of wheels are engaged with the first end of the pair of guide tracks, and in the standing position the massage table extends outward from the interior compartment and the pair of wheels are engaged with the second end of the pair of guide tracks.

25. The exercise and massage treatment table system of claim 17, wherein the planar surface of the massage table comprises a rotator disc configured to rotate through a range of motion during exercise.

* * * * *